US012398729B2

(12) United States Patent
Loercher et al.

(10) Patent No.: US 12,398,729 B2
(45) Date of Patent: Aug. 26, 2025

(54) HOUSING FOR A FAN AND FAN

(71) Applicant: ZIEHL-ABEGG SE, Künzelsau (DE)

(72) Inventors: Frieder Loercher, Braunsbach (DE); Matthias Goeller, WeiBbach (DE); Alexander Herold, Hardthausen (DE)

(73) Assignee: ZIEHL-ABEGG SE, Künzelsau (DE)

( * ) Notice: Subject to any disclaimer, the term of this patent is extended or adjusted under 35 U.S.C. 154(b) by 226 days.

(21) Appl. No.: 18/121,420

(22) Filed: Mar. 14, 2023

(65) Prior Publication Data

US 2023/0213042 A1 Jul. 6, 2023

Related U.S. Application Data

(63) Continuation of application No. 17/261,549, filed as application No. PCT/DE2019/200065 on Jun. 19, 2019, now abandoned.

(30) Foreign Application Priority Data

Jul. 16, 2018 (DE) ..... 102018211809.4

(51) Int. Cl.

| | |
|---|---|
| ***F04D 29/42*** | (2006.01) |
| ***F04D 29/28*** | (2006.01) |
| ***F04D 29/66*** | (2006.01) |
| *F04D 17/16* | (2006.01) |

(52) U.S. Cl.

CPC ..... *F04D 29/4246* (2013.01); *F04D 29/281* (2013.01); *F04D 29/422* (2013.01); *F04D 29/663* (2013.01); *F04D 17/16* (2013.01)

(58) Field of Classification Search

CPC ..... F04D 29/4246; F04D 29/4226

See application file for complete search history.

(56) References Cited

U.S. PATENT DOCUMENTS

| | | | | |
|---|---|---|---|---|
| 3,950,112 A * | 4/1976 | Crump | ..... | F04D 25/166 415/206 |
| 2018/0142700 A1* | 5/2018 | Hub | ..... | F04D 29/626 |

FOREIGN PATENT DOCUMENTS

| | | | |
|---|---|---|---|
| CN | 202170877 | U | 3/2012 |
| CN | 107044450 | B | 5/2019 |
| DE | 202017101353 | U1 | 5/2017 |
| DE | 102016226157 | A1 | 6/2018 |
| GB | 1419591 | A | 12/1975 |
| JP | H0979192 | A | 3/1997 |

(Continued)

*Primary Examiner* — Sabbir Hasan

(74) *Attorney, Agent, or Firm* — FisherBroyles, LLP; Jason P. Mueller

(57) ABSTRACT

Disclosed embodiments relate to a housing for a fan that is constructed by cutting, bending, and/or folding a single sheet of metal. A disclosed housing is configured to house a fan having a motor that is configured to rotate around an axial direction. The housing includes a first plate that is oriented in a plane that is perpendicular to the axial direction and substantially flat wall regions extending away from the first plate so as to be non-coplanar with the first plate. The housing further includes a second plate having an air intake nozzle, the second plate oriented perpendicularly to the axial direction and thereby oriented parallel to the first plate and located a first distance along the axial direction from the first plate, with the first distance being determined by a length of the wall regions. The wall regions are configured to include air flow openings.

17 Claims, 12 Drawing Sheets

(56) References Cited

FOREIGN PATENT DOCUMENTS

Figure 1:
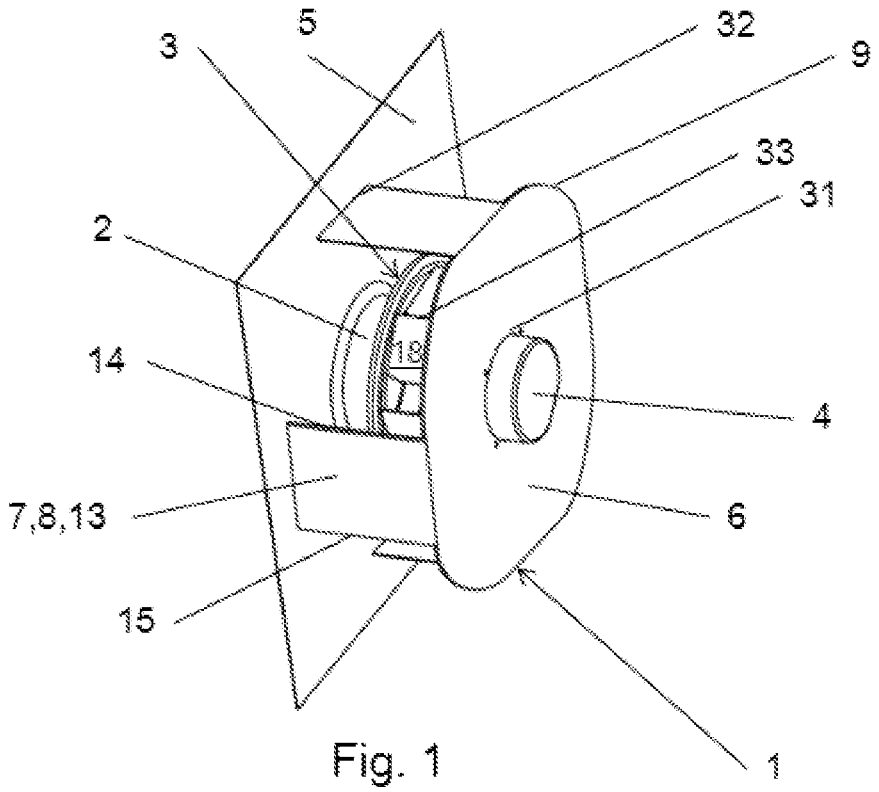

| | | | |
|---|---|---|---|
| KR | 20090035365 | | 4/2009 |
| KR | 20140018199 | | 2/2014 |
| RU | 45482 | U1 | 5/2005 |
| RU | 2330189 | C1 | 7/2008 |

* cited by examiner

HOUSING FOR A FAN AND FAN

This application is a Continuation of U.S. application Ser. No. 17/261,549 filed Jan. 19, 2021, which is a national stage entry under 35 U.S.C. 371 of PCT Patent Application No. PCT/DE2019/200065, filed Jun. 19, 2019, which claims priority to German Patent Application No. 10 2018 211 809.4, filed Jul. 16, 2018, the entire contents of each of which are incorporated herein by reference.

This disclosure relates to a housing for a fan, for example, for a radial or diagonal fan, having wall regions forming the housing.

This disclosure also relates to a fan having a corresponding housing.

Housings for fans are known in a wide variety of forms. For example, so-called spiral housings are also known, the use of which, in in radial fans, for example, increases the static efficiency in the characteristic curve range of high pressures.

However, such spiral housings are complex to produce and are only suitable to a limited extent for installation in air conditioning units, since there the air is usually guided further axially after the fan and the space is limited in the radial direction.

A fan device having a radial fan, which is arranged in a fan housing, is known from DE 10 2015 226 575 B4. More precisely, an impeller rotationally driven around a rotational axis is arranged in the housing, wherein the fan housing has a guide wall which extends in a spiral shape in a circumferential direction of the impeller and which merges into at least one air discharge opening.

Basically, radial fans can be classified into two different categories, namely a group having a spiral housing and a group of free-running radial fans.

In the known fan device, the housing is formed having four arms. Although it is also suitable for installation in air conditioning units, the housing is complex to manufacture, since four spiral-shaped guide wall segments having a special and complex construction are necessary. In addition, the housing is not suitable for centrifugal fans having rotating diffusers, namely due to the structural conditions.

This disclosure is based on the object of specifying a housing for radial fans or diagonal fans which has the effect known per se of a spiral housing, is suitable for installation in air conditioning units, and is simple to design and produce. In addition, an increase in efficiency is to be possible by way of the housing. Finally, the housing should be different from competitive products. A corresponding fan having such a housing is also to be specified.

The above object is achieved by a housing characterized in that the wall regions are essentially planar or flat.

According to this disclosure, it has been recognized that it is possible to simplify the construction of a housing according to DE 10 2015 226 575 B4, which is complex in terms of efficiency, without sacrificing the advantages of a spiral housing. This can be achieved simply in that the housing has simply formed wall regions which are essentially planar or flat, namely in contrast to conventional systems. The housing according to this disclosure consists essentially only of planar wall regions or shaped parts including folded sheet parts, wherein these can specifically be sheet metal parts.

In concrete terms, multiple, for example, four wall regions or wall elements are arranged in the circumferential direction. On the bottom disk side, a terminus plate closes the housing, to which the motor having the impeller is advantageously fastened. The sheet metal parts can be welded, screwed, riveted, or otherwise connected to one another.

In a further advantageous manner, the housing consists of an essentially one-piece metal sheet, wherein the regions are produced by folding or bending the side parts.

The simple construction results from the use of planar or flat sheet metal parts, of which the housing essentially consists, as described above. In this way, the advantages of the spiral housing may be implemented with the simplest construction, namely with corresponding formation of the respective wall regions by which air outlets may be defined.

Due to a following very detailed description of various exemplary embodiments of the claimed teaching with reference to the figures, a general description of the teaching is dispensed with at this point, with reference to the claims.

Figure 2:
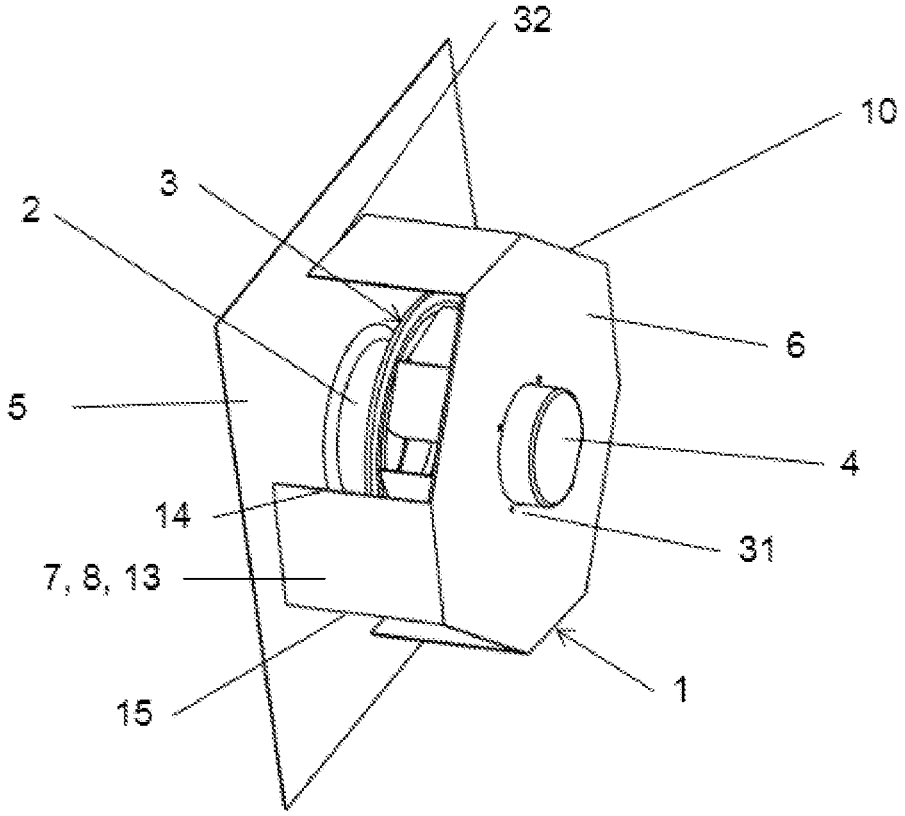
Figure 3:
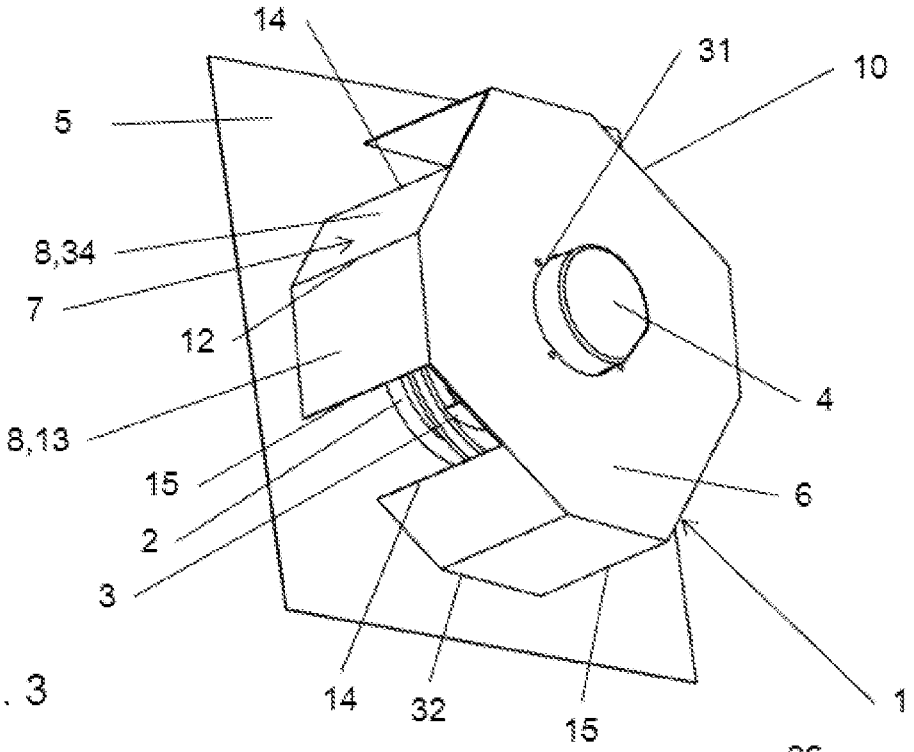
Figure 4:
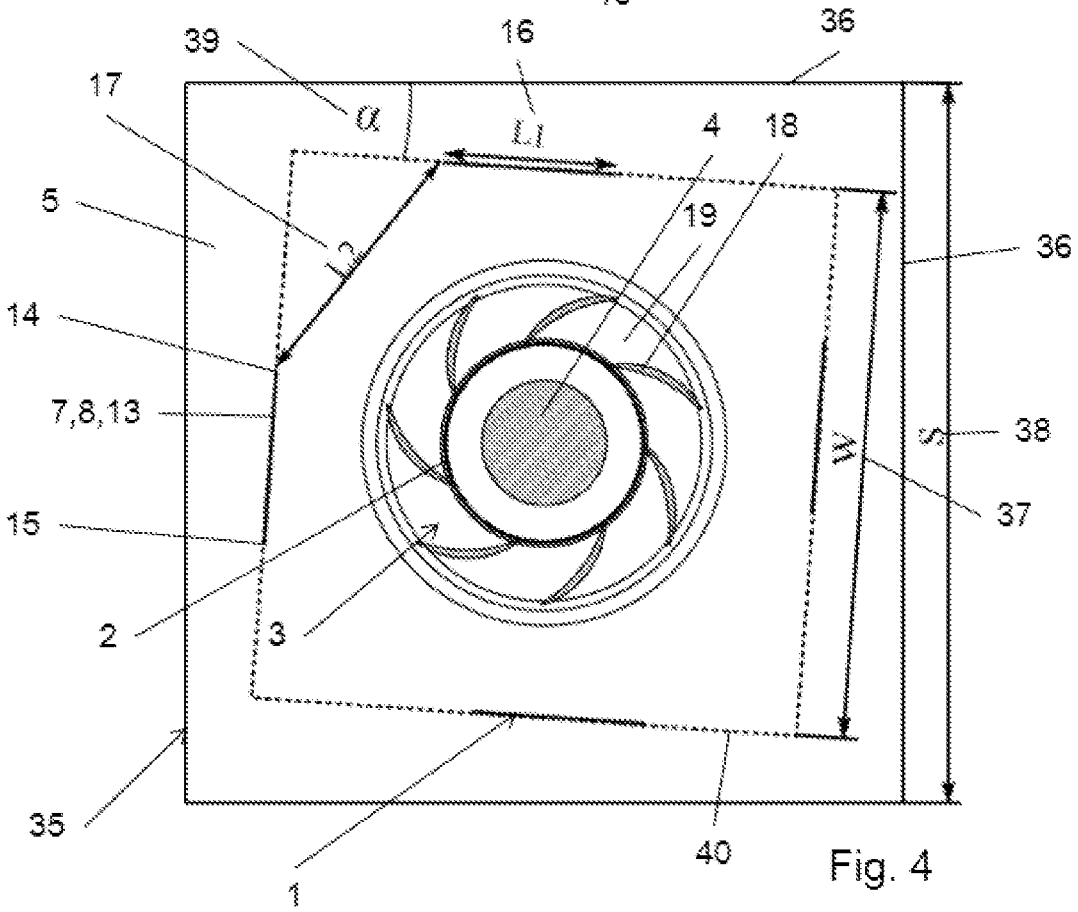
Figure 5:
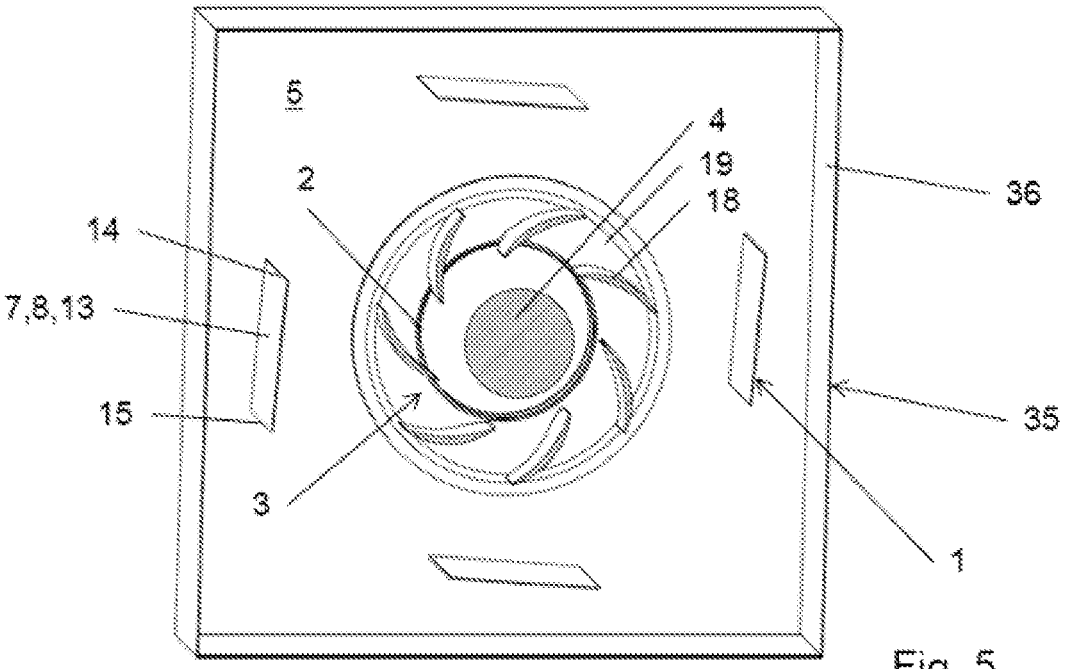
Figure 6:
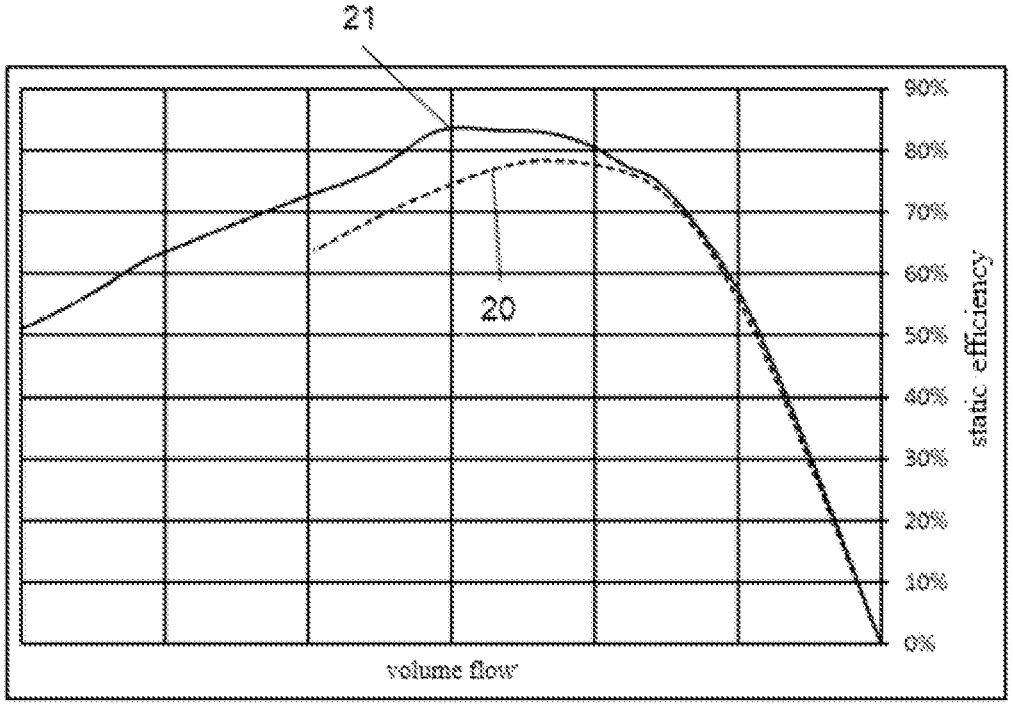
Figure 7:
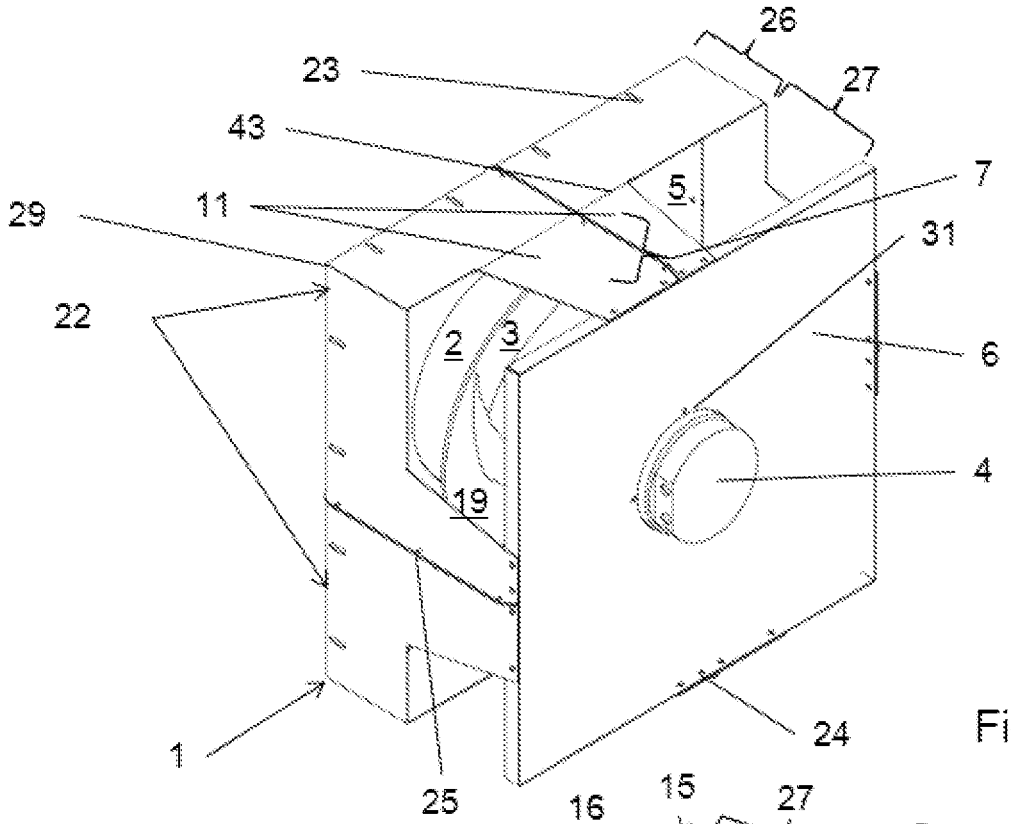
Figure 8:
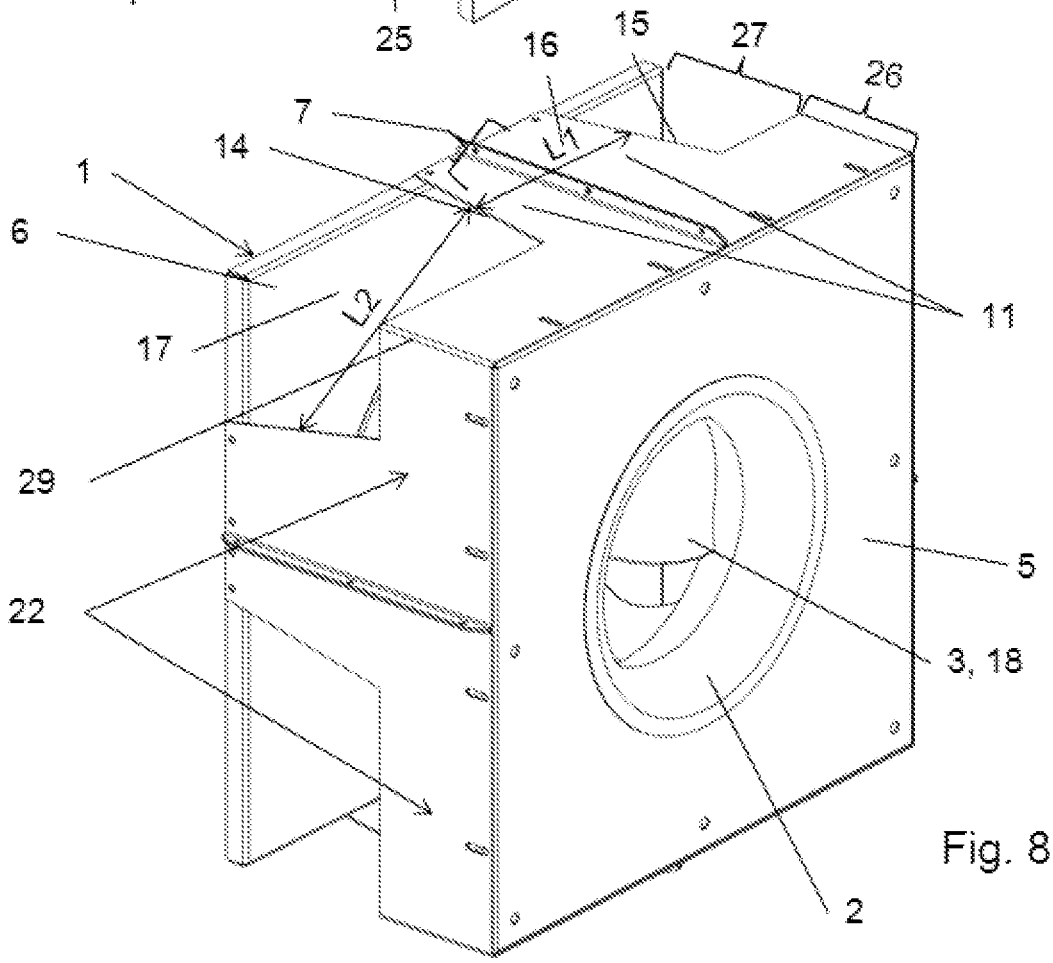
Figure 9:
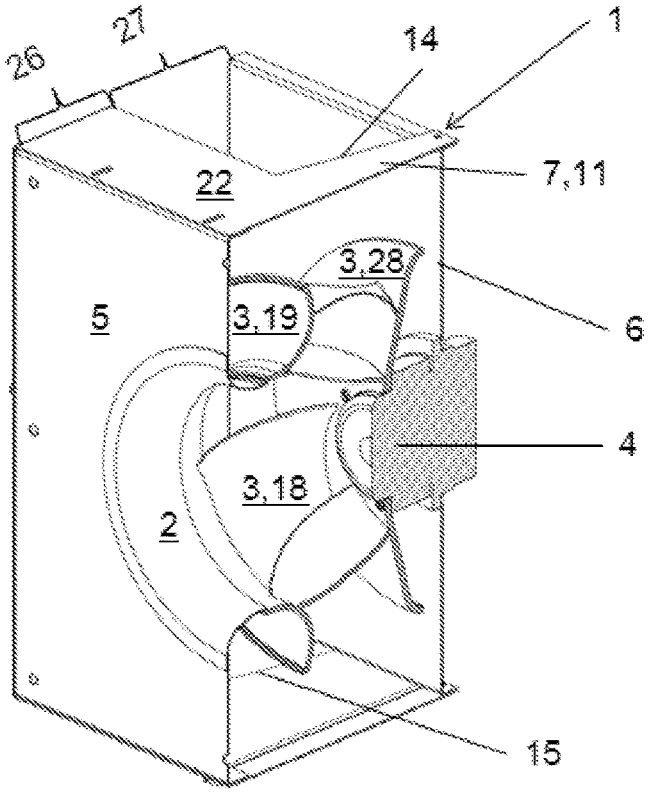
Figure 10:
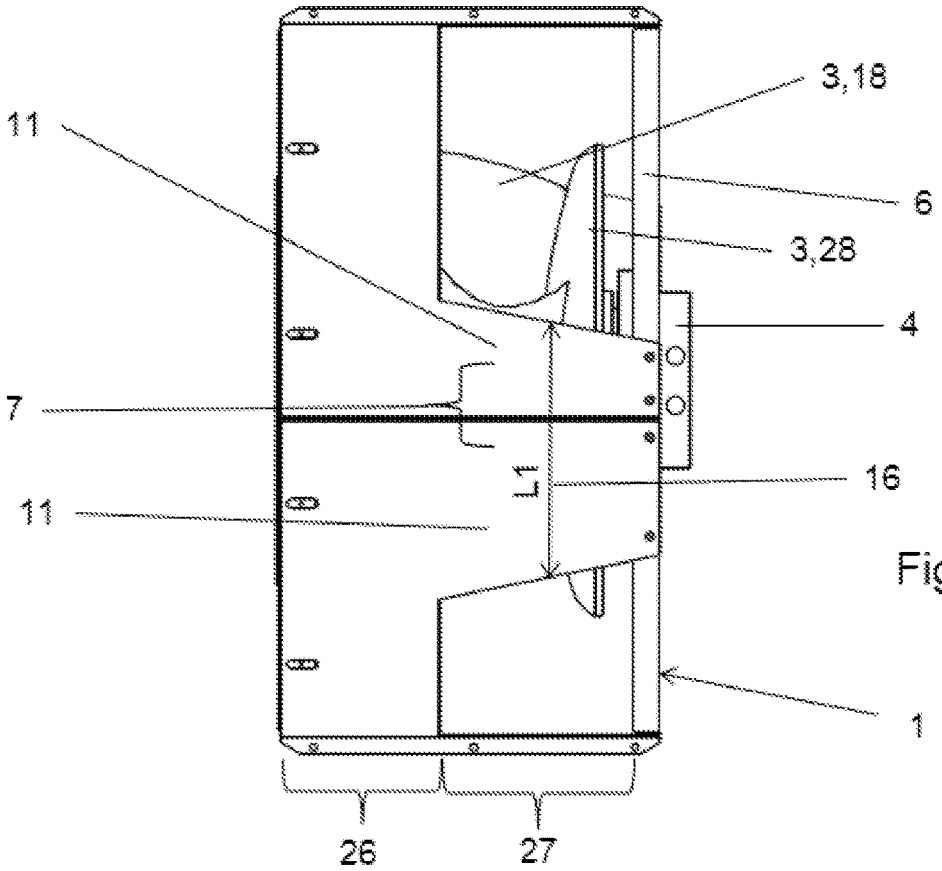
Figure 12:
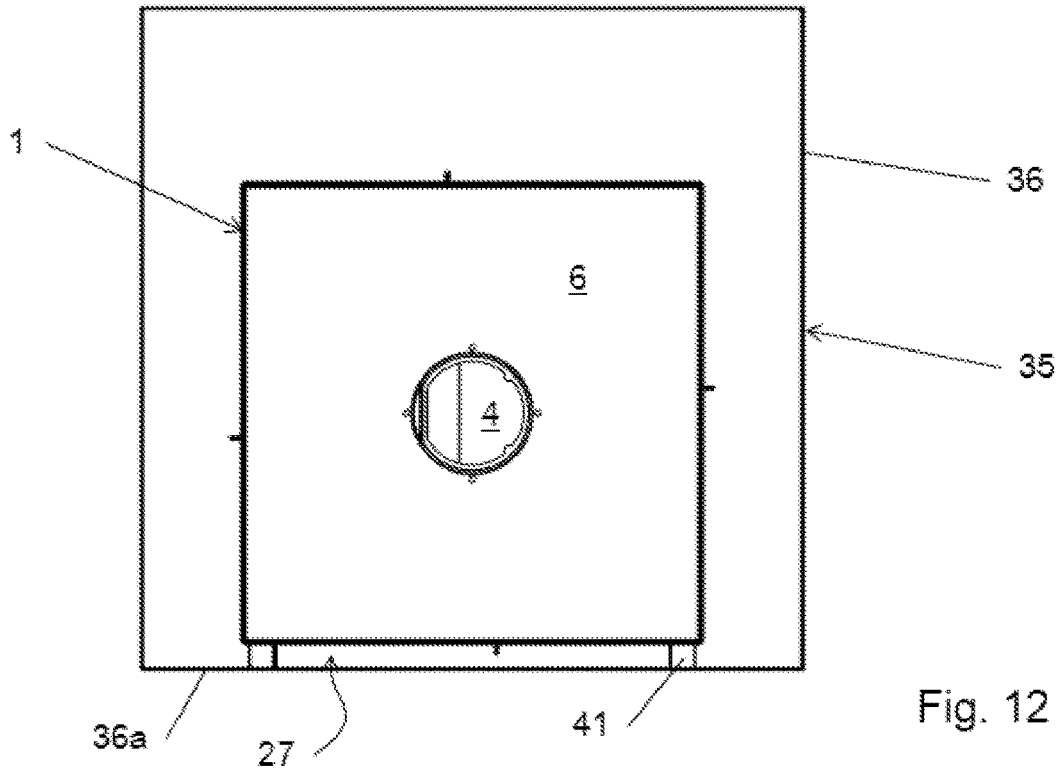
Figure 13:
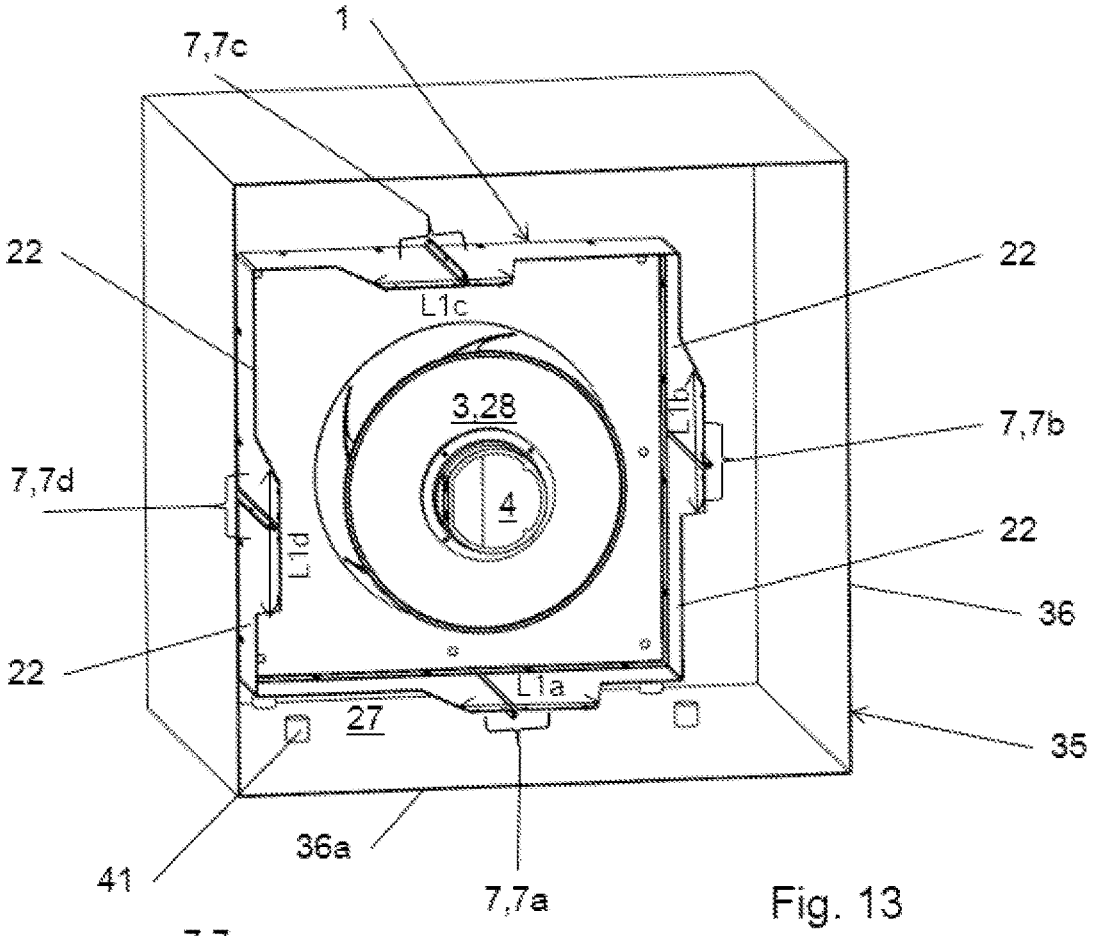
Figure 14:
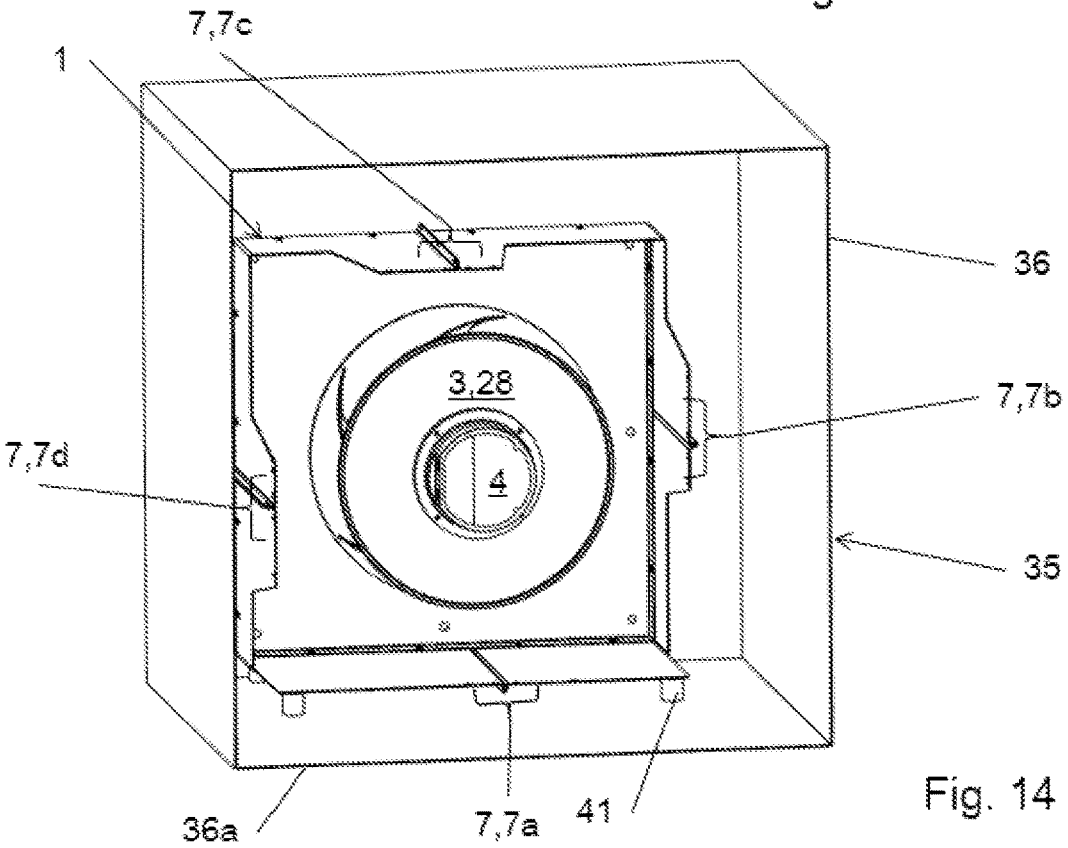
Figure 15:
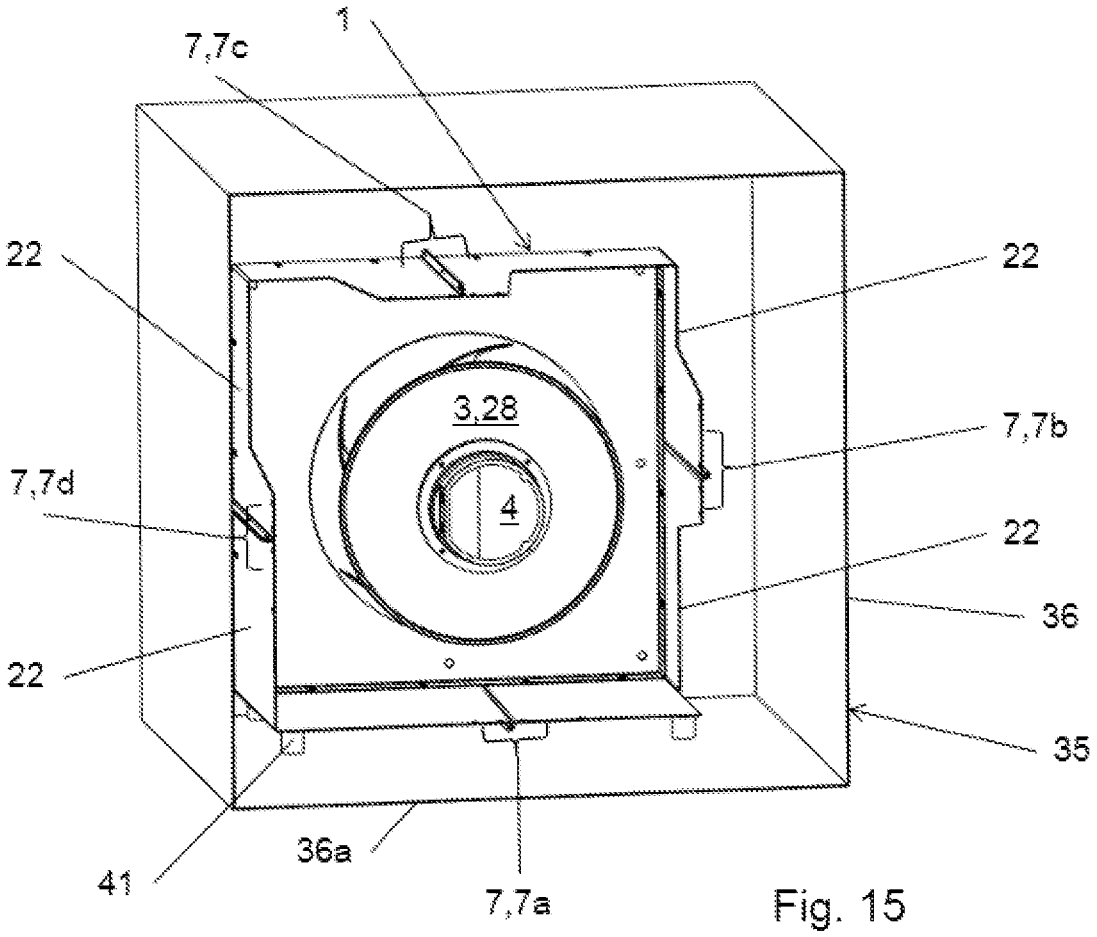
Figure 16:
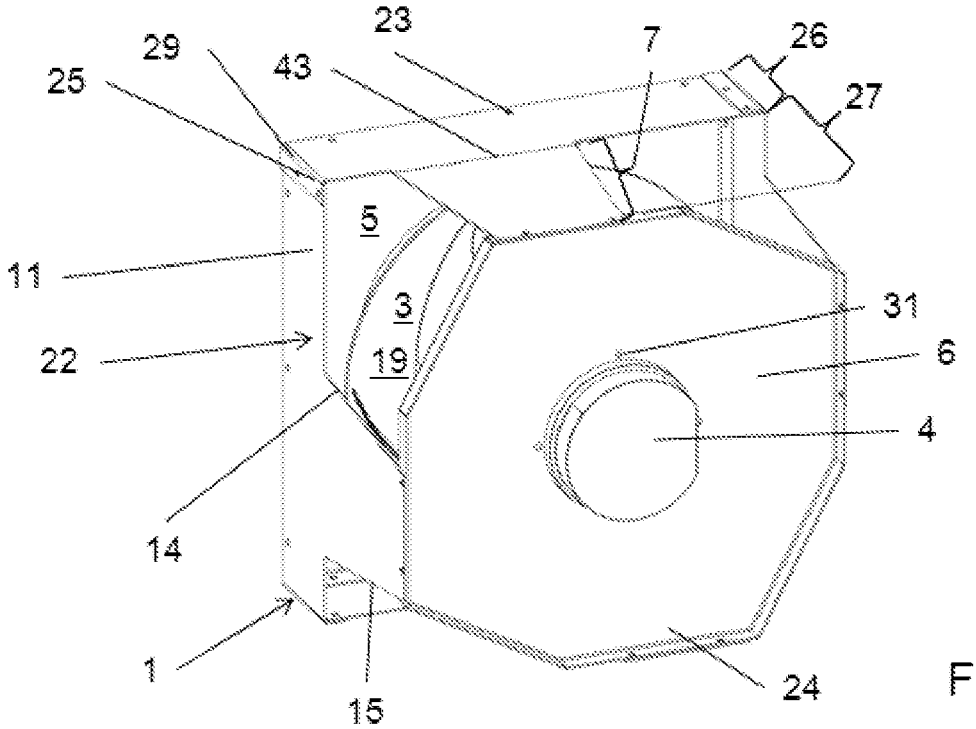
Figure 17:
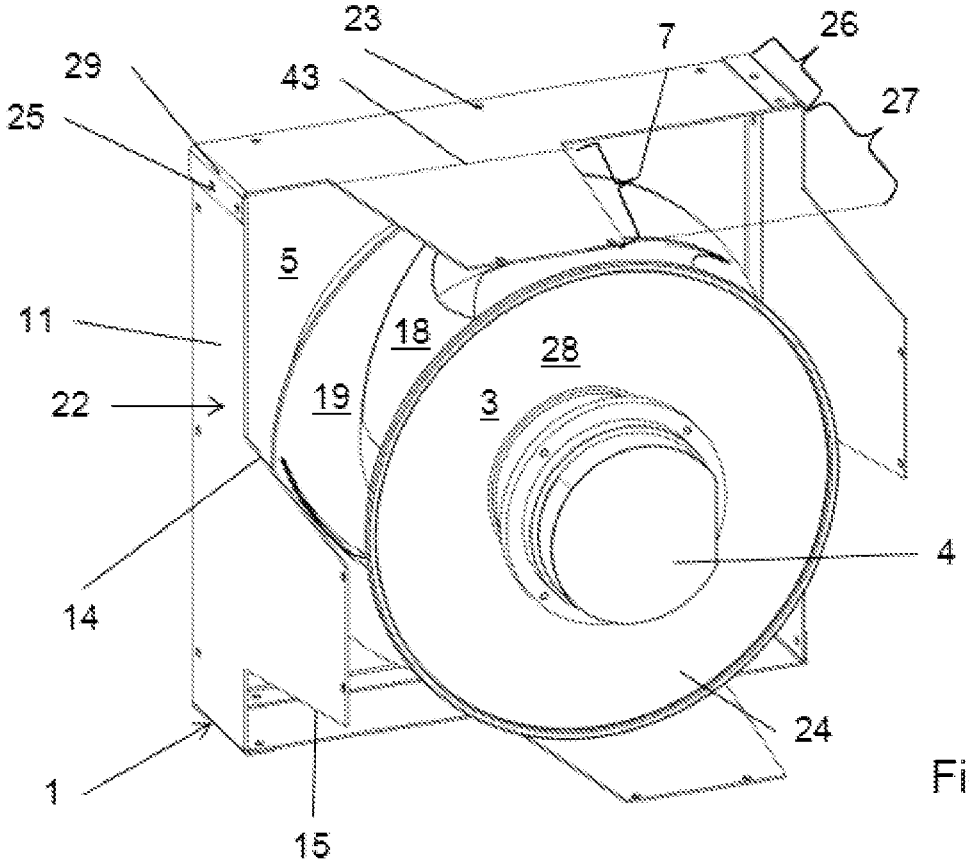
Figure 18:
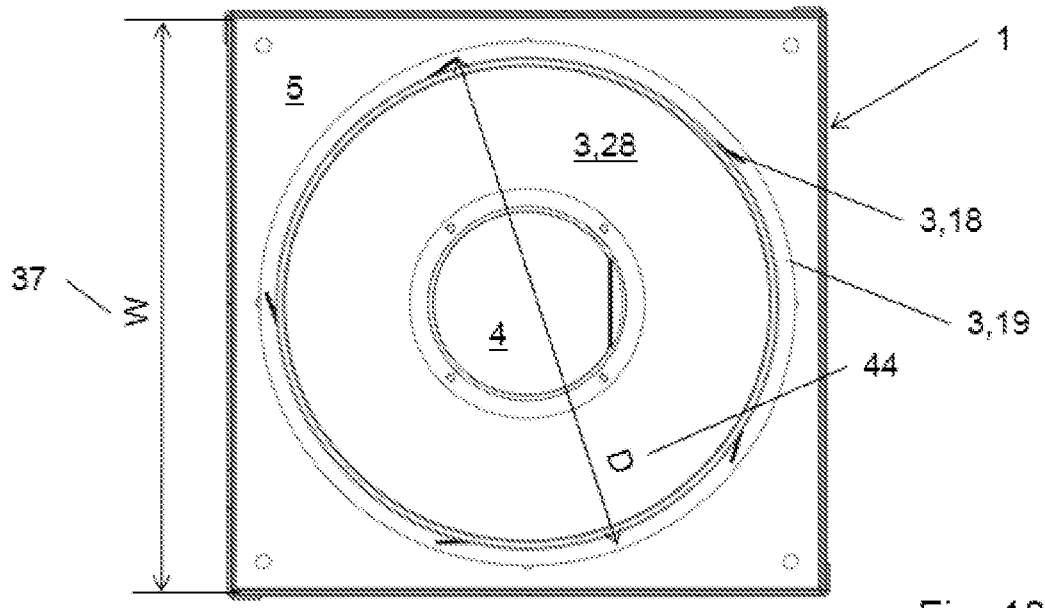
Figure 19:
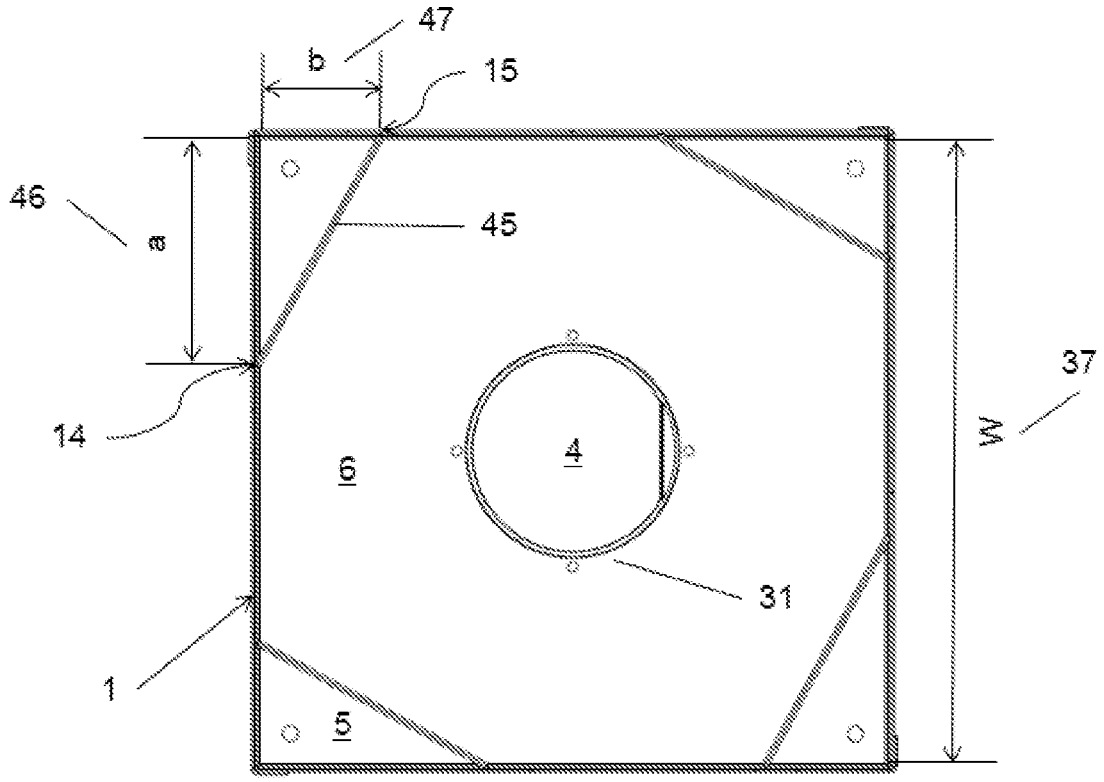
Figure 20:
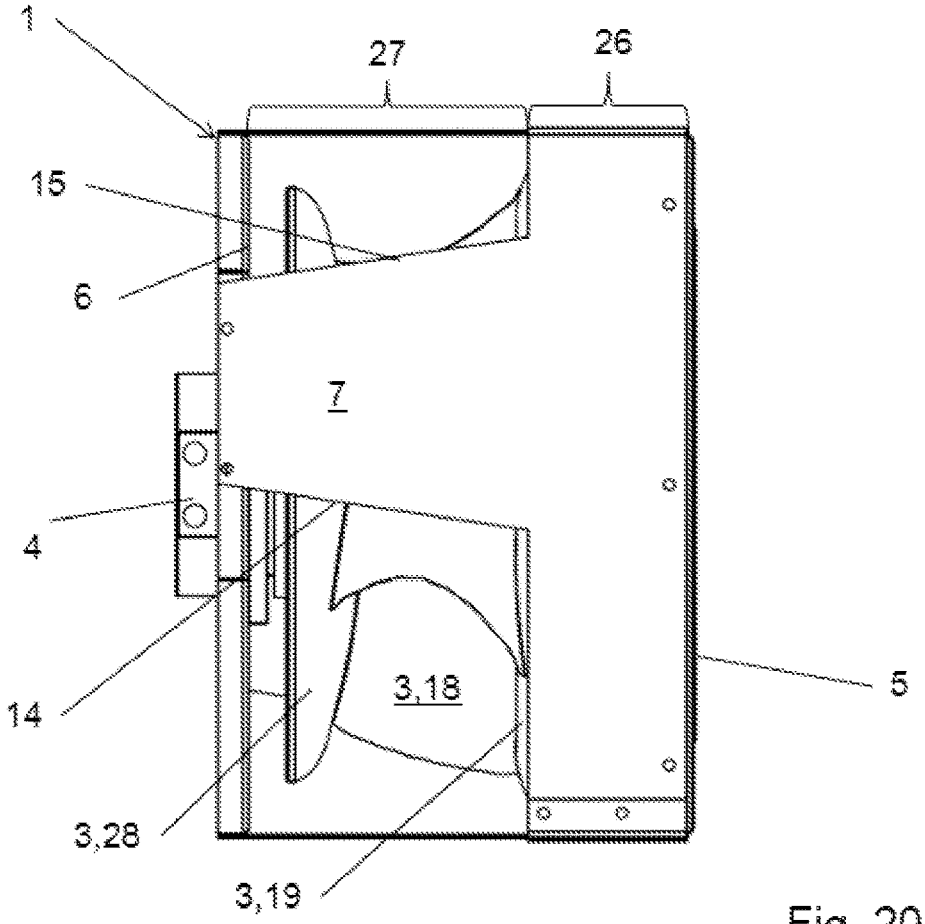
Figure 22:
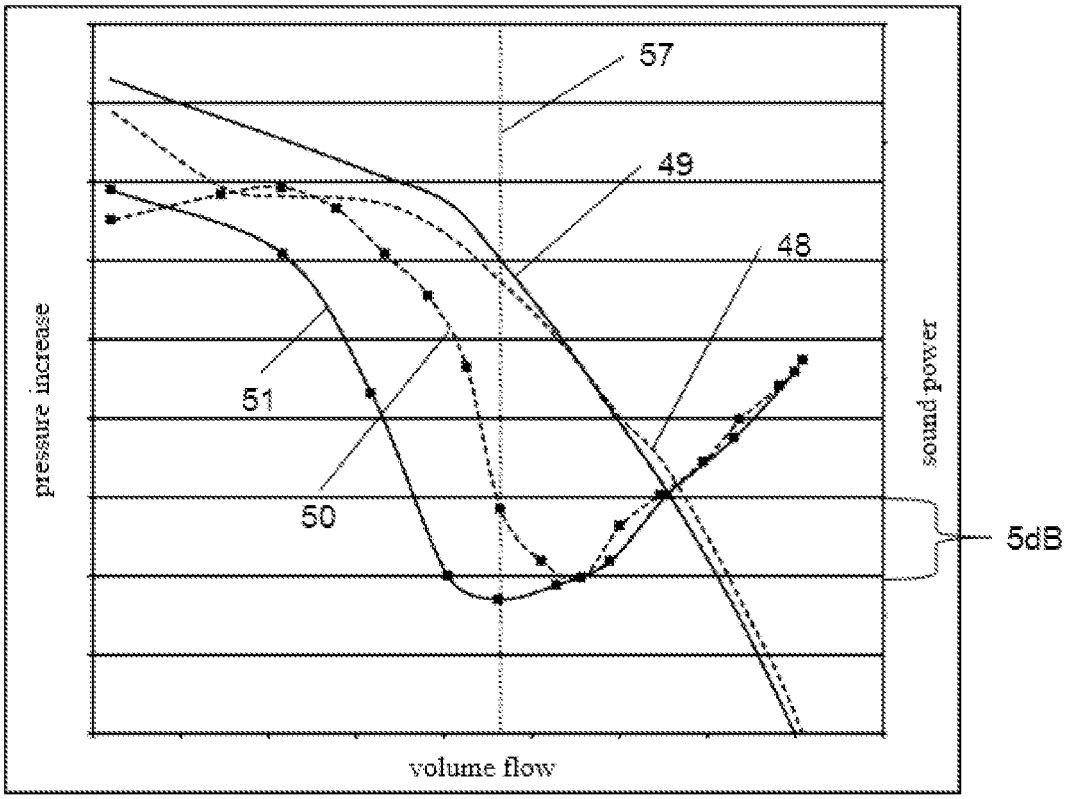
Figure 23:
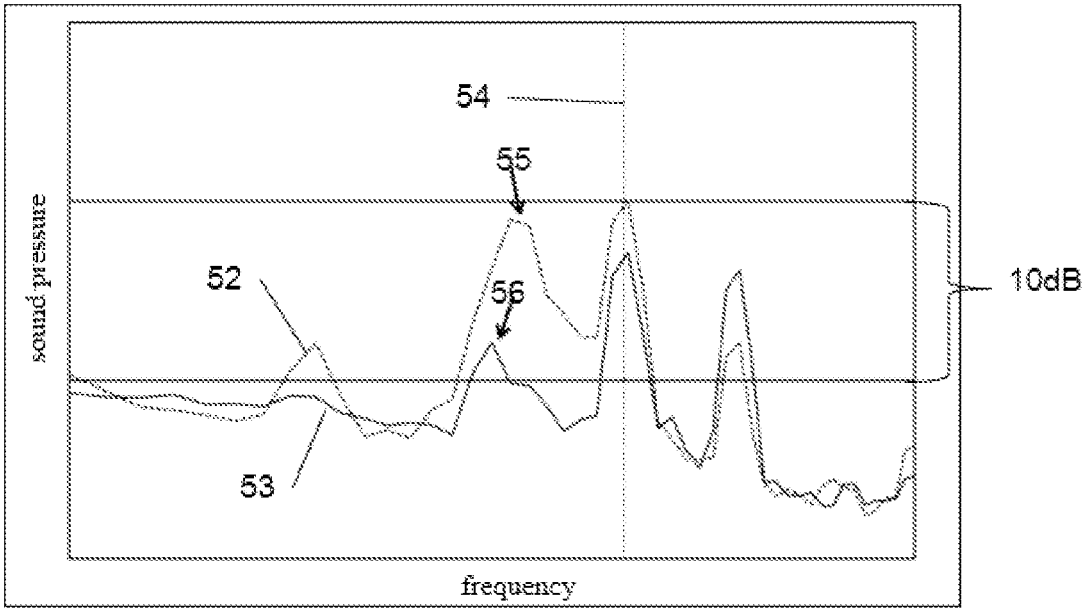

There are various options for advantageously designing and refining the teaching of the disclosure. For this purpose, reference is made on the one hand to the claims subordinate to claim 1 and on the other hand to the following explanation of exemplary embodiments of a housing according to this disclosure or a fan according to this disclosure with reference to the drawing. In conjunction with the explanation of the exemplary embodiments of this disclosure with reference to the drawing, generally designs and refinements of the teaching are also explained. In the figures FIG. 1 shows, seen in a perspective view from the outflow side, an exemplary embodiment of a fan having a housing according to an embodiment, FIG. 2 shows, seen in a perspective view from the outflow side, a further exemplary embodiment of a fan having a housing according to an embodiment, FIG. 3 shows, seen in a perspective view from the outflow side, a further exemplary embodiment of a fan having a housing according to an embodiment, FIG. 4 shows, seen in an axial top view and in a planar section from the outflow side, the fan having the housing according to FIG. 2, FIG. 5 shows, seen in an oblique view from the outflow side, the fan having the housing according to FIGS. 2 and 4, in section at a plane perpendicular to the fan axis, FIG. 6 shows the representation of the efficiency curves of a fan without housing and a fan having a housing according to an embodiment, FIG. 7 shows, seen in a perspective view from the outflow side, a fan having a further embodiment of a housing according to an embodiment, FIG. 8 shows, seen in a perspective view from the inflow side, the fan having the housing according to FIG. 7, FIG. 9 shows, seen in a perspective view from the inflow side, the fan according to FIGS. 7 and 8, in section at a plane through the fan axis, FIG. 10 shows, in a side view, the fan having the housing according to FIGS. 7 to 9, FIG. 11 shows, seen in a perspective view from the outflow side, a fan having a further embodiment of a housing according to an embodiment having perforated side parts, FIG. 12 shows, seen in an axial top view from the outflow side, a fan having a further embodiment of a housing installed on the bottom of an air duct, FIG. 13 shows, seen in a perspective view from the outflow side, the fan having the housing in an air duct according to FIG. 12, wherein the plate on the bottom disk side of the housing is not shown, FIG. 14 shows, seen in a perspective view from the outflow side, a fan having a further embodiment of a housing installed on the bottom of an air duct, wherein the plate on the bottom disk side of the housing is not shown, FIG. 15 shows, seen in a perspective view from the outflow side, a fan having a further embodiment of a housing installed on the bottom of an air duct, wherein the plate on the bottom disk side of the housing is not shown, FIG. 16 shows, seen in a perspective view from the outflow side, a fan having a further embodiment of a housing, which is compact in the radial direction, FIG. 17 shows, seen in a perspective view from the outflow side, the fan having the housing according to FIG. 16, wherein the plate on the bottom disk side of the housing is not shown for reasons of illustration, FIG. 18 shows, seen in an axial top view from the outflow side, the fan having the housing according to FIG. 16 and FIG. 17, wherein the plate on the bottom disk side of the housing is not shown for reasons of illustration, FIG. 19 shows, seen in an axial top view from the outflow side, the fan having the housing according to FIGS. 16 to 18, wherein the plate on the bottom disk side of the housing is not shown, FIG. 20 shows a side view of the fan having the housing according to FIGS. 16 to 19, FIG. 21 shows, seen in a perspective view from the inflow side, a fan having a further embodiment of a housing, which is compact in the radial direction and the side parts of which are perforated, FIG. 22 shows the representation of the curves of the static pressure increases and the suction-side sound powers of a fan without housing and of a fan having a housing according to an embodiment at constant speed, FIG. 23 shows the representation of spectra of the suction-side sound pressure of a fan without housing and of a fan having a housing according to an embodiment at constant speed and equal delivery volume flow.

FIG. 1 shows an exemplary embodiment of a fan having a housing 1 according to this disclosure in a perspective illustration seen from the outflow side. Inside, the fan impeller 3, advantageously of radial or diagonal design, having motor 4 and inlet nozzle 2 can be seen. The housing 1 consists of an advantageously planar plate 6 on the bottom disk side and several side parts 7 radially outside (outflow side) of the air outlet of the fan impeller. Four side parts 7 are advantageously provided. The side parts 7 cover a part of the outflow surface, whereby the flow is stabilized. The static efficiency of the fan is improved in characteristic curve ranges of high pressure. The side parts 7 are planar in the exemplary embodiment, that is, they essentially consist of a one-piece, coherent planar or flat region 8. This can be advantageous for simple and inexpensive manufacturing of the housing 1 or its side parts 7 in sheet metal. For example, the entire housing 1 can be made from a metal sheet by cutting and folding. In the region of the motor 4, suitable fastening and centering devices are provided in the central region 31 of the plate 6 on the bottom disk side. In the connecting region 32 to the nozzle plate 5, in the case of a load-bearing embodiment, fastening provisions (not shown) are advantageously also provided, for example folded flanges for screwing on or riveting on. A load-bearing embodiment means that the fan impeller 3 having the motor 4 is fastened in a load-bearing manner on the nozzle plate 5 or on another receptacle via the plate 6 on the bottom disk side and the side parts 7.

The housing 1 can also be configured as non-load-bearing. In this case it is not absolutely necessary for the side parts 7 to extend up to the nozzle plate 5. However, it has been shown that it is advantageous if there is at most a small gap between the side plates 7 and the nozzle plate 5 (<D/10, wherein D is the average diameter of the trailing edges 33 of the blades 18 of the fan impeller 3 with respect to the impeller axis).

The plate 6 on the bottom disk side extends up to the side parts 7. In the exemplary embodiment, the plate 6 on the bottom disk side has a rounded transition region 9 in the regions between respective adjacent side parts 7.

The side parts 7 each have an inflow-side edge 14 and an outflow-side edge 15. The inflow-side edge 14 and the outflow-side edge 15 are the boundaries of the side parts 7, seen in the circumferential direction. The inflow-side edge 14 of a side part 7 lies in front of the outflow-side edge 15 of the same side part 7, seen in the rotational direction of the fan impeller 3.

FIG. 2 shows a further exemplary embodiment of a housing 1 according to this disclosure, seen in a perspective illustration from the outflow side. In contrast to the exemplary embodiment according to FIG. 1, straight transition regions 10 are embodied on the plate 6 on the bottom disk side between respective adjacent side parts 7. It is important that the plate 6 on the bottom disk side extends up to the side parts 7. The side parts 7 are essentially each constructed from a one-piece planar region 8, advantageously in sheet metal. The entire housing 1 is essentially constructed from planar regions. The plate 6 on the bottom disk side is also essentially planar.

FIG. 3 shows a further exemplary embodiment of a fan having a housing 1 according to this disclosure seen in a perspective view from the outflow side. In contrast to the exemplary embodiment according to FIGS. 1 and 2, each side part 7 of the housing 1 consists of two planar regions 8, which each press against one another at a transition 12. The entire housing 1 including its side parts 7 is made up exclusively of essentially planar regions, which significantly facilitates the manufacturing from sheet metal. For example, no molding tools such as embossing tools are required for its production. It is also not necessary to provide the sheets with a curve by rounding them. For example, the housing 1 shown can be produced by trimming or punching and folding from a single sheet metal plate, or from multiple sheet metal parts, which are each prefabricated by trimming or punching and possibly folding and then connected to one another by screwing, welding, riveting, or the like. For this purpose, connecting elements can be provided on the connecting regions of adjacent sheet metal parts, for example folded screw or rivet flanges. Of the two planar regions 8 of each side part 7, one has the inflow-side edge 14 and one has the outflow-side edge 15. The inflow-side edge 14 of a side part 7, seen in the rotational direction of the fan impeller 3, lies in front of the outflow-side edge 15 of the same side part 7. The planar region 8 having the outflow-side edge 15 is referred to as the radially outermost planar region 13 of the side part 7, since on average it has a greater distance to the fan axis than the planar region 8 having the inflow-side edge 14. In the embodiments according to FIGS. 1 and 2, the only planar region 8 of each side part 7 is at the same time also the radially outermost planar region of the respective side part 7. In the exemplary embodiment according to FIG. 3, straight transition regions 10 are formed on the plate 6 on the bottom disk side of the housing 1 between respective adjacent side parts 7. In the exemplary embodiment, these straight transition regions 10 are approximately the straight continuations of the transitions between the radially innermost planar region 34 and the plate 6 on the bottom disk side. As in the other exemplary embodiments, fastening provisions can advantageously be provided at the connecting region 32 between the side parts 7 and the nozzle plate 5.

FIG. 4 shows the fan having the housing 1 according to FIG. 2 installed in an air duct 35 in a section at a plane perpendicular to the fan axis and approximately in the middle of the axial height of the housing 1, seen in an axial top view from the outflow side. The fan impeller 3 can be seen on the inside and the four side parts 7 on the outside, each of which consists of a planar region 8, which at the same time also forms the radially outermost planar region 13. In the exemplary embodiment, the housing 1 has at least approximately 90° rotational symmetry with respect to the fan axis. A length L1 (16) of a radially outermost planar region 13 is shown, seen in section, and a distance L2 (17) of two radially outermost planar regions 13 adjacent in the circumferential direction, also seen in section. L1 (16) is less than L2 (17). L2 (17) is advantageously approximately 1.5-2.5 times L1 (16). L1 (16) is advantageously approximately 45%-65% of the mean diameter D of the trailing edges 33 of the blades 18 of the fan impeller 3 with respect to the fan axis. In embodiments having multiple planar regions 8 of the side parts 7, for example the embodiment according to FIGS. 3, L1 (16) and L2 (17) are only defined on the basis of the radially outermost planar regions 13, ignoring the remaining planar regions 8. If the inflow-side edge 14 of a side part 7 and/or the outflow-side edge 15 of a side part 7 do not extend in parallel to the fan axis, L1 (16) and L2 (17) are not constant for different planes of section. In such a case, the mean values for L1 (16) and L2 (17) for a radially outermost planar region 13 or for the distance between two adjacent outermost planar regions 13 are to be used for the evaluation.

Because L2 (17) is greater than L1 (16) to the extent described, there is very good accessibility to the fan impeller 3 despite the presence of the housing 1, for example for maintenance or cleaning purposes, without having to dismantle the housing 1.

The housing 1 has, in the section shown or in an axial top view, a width w (37). It is defined by the side length of the smallest square 40 circumscribed around the housing 1 in section at a plane perpendicular to the axis or in an axial top view. The width w (37) of the housing 1 is advantageously 1.5-1.7 times the mean diameter D of the trailing edges 33 of the blades 18 of the fan impeller 3. The mean length L1 of the radially outermost region 16 of a side part 7 of the housing 1 is advantageously approximately 25%-45% of the width w (37) of the housing 1. If the width w is variable for different planes of section, the width w averaged over the entire axial height of the housing 1 is to be used for the evaluation.

The air duct 35 has four side walls 36. According to the section from FIG. 4, it has a width s (38). If an air duct has an approximately rectangular cross section having different side lengths s1 and s2, s can either be determined as the smaller value of s1 and s2 or according to the formula s*s=s1*s2. If multiple fans having housings 1 are installed in parallel in an air duct, then only the imaginary region of the air duct 35 to be associated with it is considered for each fan, as if partition walls were always incorporated in the middle between adjacent fans parallel to the side walls 36 of the air duct 35. The width s (38) of the air duct 35 associated with a fan is advantageously in the range of 1.25 times to 1.6 times the width w (37) of the associated housing 1.

If the ratio s/w of the width s (38) of the air duct 35 associated with a fan and the width w (37) of the associated housing 1 is less than 1.4, it can be advantageous to install the housing 1 slightly rotated relative to the air duct 35 in order to minimize the deflection losses. As a result, the radial space in the regions of the corners of the air duct 35 can be used to improve flow. This creates an angle α (39) between the housing 1 and the associated air duct 35, as shown in FIG. 4. The angle lies between one side of the smallest circumscribed square 40 of the associated housing 1 and the closest side wall 36 of the associated air duct 35. The angle α (39) is advantageously in a range of approximately 5°-20°.

FIG. 5 shows, seen in a diagonal view from the outflow side, the fan having the housing 1 and the air duct 35 according to FIG. 4, in section at a plane perpendicular to the fan axis, Here, the housing 1 is installed in an air duct 35. This means that after exiting the housing 1, the outflowing air is deflected in a direction approximately parallel to the observer. The cover disk 19 and, in section, the blades 18 can be seen of the fan impeller 3 arranged centrally in the housing 1. In the center of the impeller 3, the drive motor 4 is shown schematically in section. The rotational direction of the impeller is, in this illustration, counterclockwise. The trailing edge of the inlet nozzle 2 located on the inflow side facing away from the observer can be seen, which is in the central inflow opening of the cover disk 19. The plate on the bottom disk side cannot be seen in this sectional illustration. Otherwise, reference can be made to the description of FIG. 4.

FIG. 6 schematically shows the representation of the efficiency curves of a fan without housing and a fan having a housing according to this disclosure. The static efficiency achieved in each case is plotted as a function of the volume flow at a constant speed of the fan. The dashed efficiency characteristic curve 20 was achieved with measurements of a backward curved centrifugal fan without a housing, whereas the solid efficiency characteristic curve 21 was achieved with measurements of the same fan but with an additionally attached housing according to this disclosure. It can be clearly seen that, at low volume flows, that is to say at high pressures, the efficiency is markedly increased by a housing according to this disclosure. In the case of high volume flows or low pressures, the improvement is rather less. In the range of low volume flows or high pressures, the improvement is a few percentage points, for example, it can be at least 3 percentage points.

In FIG. 7, a further exemplary embodiment of a fan having a housing 1 according to this disclosure is shown seen in a perspective view from the outflow side. The housing 1 has an essentially square plate 6 on the bottom disk side, which, however, has folded edges with bores on its radially outer edges, which form provisions 24 for fastening the plate 6 on the bottom disk side to the side parts 7. These parts can be fastened to one another with screws, rivets, welding, or the like. In the exemplary embodiment, the parts are screwed together. The central region 31 of the plate 6 on the bottom disk side is embodied as a receptacle for a motor 4 having corresponding bores and centerings. Overall, the plate 6 on the bottom disk side is manufactured as an integral sheet metal part. Integral sheet metal part means that the sheet metal part is formed from a single sheet metal plate by cutting and forming.

In contrast to the exemplary embodiments according to FIGS. 1-5, a stabilization region 26 is formed in the embodiment according to FIG. 7. In this stabilization region 26 starting from the nozzle plate up to about 30%-70% of the axial length to the plate 6 on the bottom disk side, the housing 1 is essentially closed over the entire circumference. This means that there are no significant through-flow openings over the entire circumference in this region. In contrast, a through-flow region 27 extends between the stabilization region 26 and the plate 6 on the bottom disk side. This is, viewed over the circumferential direction, characterized by the alternating presence of through-flow openings and the side parts 7. The side parts 7 are to be understood as aerodynamic entities which, viewed in the axial direction, extend only over the through-flow region 27. In FIG. 7, the imaginary edge 42 of a side part 7 toward the stabilization region 26 is shown by dashed lines. A coherent side part 7 can, as in the exemplary embodiment, be formed from multiple integral sheet metal parts 22, and an integral sheet metal part 22 can simultaneously form side parts 7 and other parts, for example regions of the stabilization region 26.

In the exemplary embodiment according to FIG. 7, the housing 1, which surrounds the fan impeller 3, is made up of the plate 6 on the bottom disk side and four further integral sheet metal parts 22, the latter forming the stabilization regions 26 close to the nozzle plate 5 and the side parts 7. Each of these 4 integral sheet metal parts 22 extends on a folded edge over a corner region 29 of the housing 1, and each of these 4 sheet metal parts forms 2 planar subregions 11 of two side parts 7 following one another in the circumferential direction. For cost-effective manufacturing, it is advantageous that all sheet metal parts of the housing 1, in the exemplary embodiment the plate 6 on the bottom disk side and the four integral sheet metal parts 22, can be manufactured without contouring tools by trimming or punching and folding, since they are essentially composed exclusively of planar regions. The connection in the circumferential direction of adjacent integral sheet metal parts 22 takes place at folded flange regions, which serve as fastening provisions 25 and which in the exemplary embodiment extend transversely through the side parts 7 of the housing 1. This construction is stable and rigid and easy to produce. The four integral sheet metal parts 22 are essentially identical in the exemplary embodiment. The housing 1 is thus essentially rotationally symmetrical with respect to the fan axis with a four-fold division.

The nozzle plate 5 terminates the housing 1 toward the inflow side of the fan. Fastening provisions 23 for fastening the housing 1 to a nozzle plate 5 or a device wall that takes on the function of the nozzle plate are integrated on the stabilization region 26 or the integral sheet metal parts 22 forming it. These fastening provisions 23 can be bores, elongated holes, or also folded flange regions which facilitate the fastening of the housing 1 to the nozzle plate 5 or the device wall with screws, rivets, or the like. The stabilization region 26 has, seen in cross section at a plane perpendicular to the fan axis, an approximately rectangular contour, which is advantageous for the aerodynamic function. This region stabilizes the recirculating air flow that re-enters the radial gap between the inlet nozzle 2 and the cover disk 19 of the fan impeller 3, thereby increasing the efficiency and reducing the sound.

FIG. 8 shows, seen in a perspective view from the inflow side, the fan having the housing 1 according to FIG. 7. The inlet nozzle 2 is integrated in the nozzle plate 5. It can be formed integrally from the sheet metal part that also forms the nozzle plate 5, or can be embodied as a separate component also made of sheet metal or of plastic injection molding, which is fastened to the nozzle plate 5, for example, by screws or rivets. During operation, the air flows through the inlet nozzle 2 into the rotating fan impeller 3 having its blades 18, and after the energy transfer by the impeller, is conveyed radially outward through the open regions of the through-flow region 27. The housing 1 increases the static efficiency of the fan. The rotational direction of the impeller is, in the exemplary embodiment, clockwise when looking from the inflow side into the inlet nozzle 2. The side parts 7, each formed from 2 planar regions 11, each have an inflow-side edge 14 and an outflow-side edge 15. In the exemplary embodiment, the edges are not axially aligned, i.e. they do not extend in parallel to the fan axis, but are oblique. The length L1 (16) of the side parts 7 is not constant when viewed in section at planes perpendicular to the fan axis (corresponding to FIG. 4). For the evaluation (see description of FIG. 4), the mean value of L1 (16), seen over the axial extent of the side parts 7, is used. Equivalently, the length L2 (17) is also not constant and the mean value of L2, seen over the axial extent of the side parts 7, is also to be used for the evaluation. The integral sheet metal parts 22 are folded over in the region of the stabilization regions 26 at the corner regions 29.

In FIG. 9, seen in a perspective view from the inflow side, the fan having housing 1 according to FIGS. 7 and 8 is shown, in section at a plane through the fan axis. The fan impeller 3 consists of a cover disk 19, a bottom disk 28, and blades 18 extending between them. It is driven by the motor 4 and is fastened to the motor 4. The motor 4 is connected to the nozzle plate 5 via the plate 6 on the bottom disk side, the side parts 7, and the stabilization regions 26 or the integral sheet metal parts 22 forming these regions. The housing 1 is thus configured in a load-bearing manner. Alternatively, the motor 4 with the impeller 3 could be fastened to the nozzle plate 5 or in some other way independently of the housing. Then the housing 1 would not have a load-bearing design and could either be fastened to the nozzle plate 5, a device wall, or to the motor 4.

In the exemplary embodiment in the illustration shown, when the fan is in operation, the air flows essentially from the left into the inlet nozzle 2, then between cover disk 19, bottom plate 28, and blades 18 through the impeller 3, which transfers energy to the air, and after exiting from the fan impeller 3, in the radial direction through the open regions of the through-flow region 27. A small portion of the air flow, however, recirculates after exiting the impeller 3 in a region at the level of the stabilization region 26 through the radial gap between the inlet nozzle 2 and the cover disk 19 of the impeller 3 back into the impeller 3 and stabilizes the flow on the cover disk 19 in the impeller 3, which results in significant advantages in terms of energy efficiency and low noise.

The design of the stabilization region 26 according to this disclosure makes a significant contribution to this flow stabilization in a positive manner.

In FIG. 10, the fan having the housing 1 according to FIGS. 7 to 9 is shown in a side view. The stabilization region 26 extends in the exemplary embodiment, seen in this side view perpendicular to the fan axis, slightly over the (not visible) cover disk 19 of the impeller 3. The plate 6 on the bottom disk side is at an axial distance from the bottom disk 28 of the impeller 3. Overall, the width, seen in the axial direction, of the flow region 27 is at least 90% of the width, seen in the axial direction, of the air outlet from the impeller 3, i.e. the axial distance between cover disk 19 and bottom disk 28, observed in each case at their radially outer end.

Figure 11:
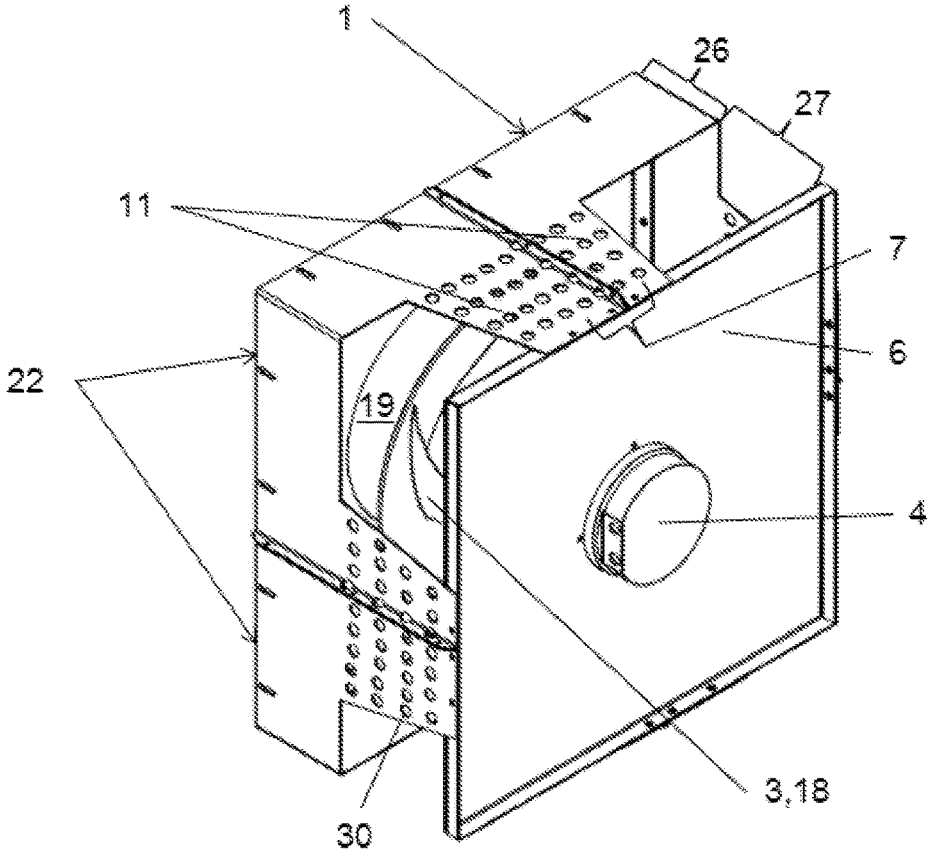

A further exemplary embodiment of a fan having the housing 1 according to this disclosure is shown seen in a perspective view from the outflow side in FIG. 11. The side parts 7 of the housing 1 are each provided with a number of perforations 30. The perforations 30 result in a reduction of the noise. They advantageously have a diameter of 0.5%-4% of the diameter of the impeller 3 and are distributed approximately uniformly over the side parts 7.

It is generally also conceivable to provide the open regions of the through-flow regions 27 with a touch protection grille. This would provide complete touch protection against reaching into the fan impeller 3 from the outflow side. Such a touch protection grille can advantageously even be integrated into the integral sheet metal parts 22.

In FIG. 12, seen in an axial top view from the outflow side, a fan having a further embodiment of a housing 1 is installed on the bottom 36*a* of an air duct 35. The housing is fastened to the bottom wall 36*a* of the air duct 35 using 4 bottom fastening elements 41, which are advantageously embodied as damper elements. In the exemplary embodiment, the housing 1 is configured to be load-bearing, that is, the motor 4 having the fan impeller 3 is fastened to the load-bearing housing 1. The fastening to the bottom wall 36*a* of the air duct 35 generally results, seen in an axial top view, in an asymmetrical arrangement of the housing 1 or the fan impeller 3 with respect to the air duct 35. For example, the distance of the bottom wall 36*a* to the housing 1 is significantly less than the distances from one or more other side walls 36 of the air duct 35 to the housing 1. The air outflow from the housing 1, through the through-flow region 27, in the direction of the bottom wall 36*a*, is greatly impaired or completely prevented by this. Additional installation losses result accordingly. An embodiment design of the housing 1 can advantageously be used for this type of installation, which then in turn has asymmetries in order to better deal with the asymmetry of the installation situation.

FIG. 13 shows, seen in a perspective view from the outflow side, the fan having the housing 1 in an air duct 35 according to FIG. 12, wherein the plate 6 on the bottom disk side is not shown (is hidden) for better illustration. The four damper elements 41, using which the housing 1 is fastened to the bottom wall 36*a* of the air duct 35, can be seen. The two damper elements 41, which are closer to the observer, are fastened to the plate 6 (not shown) on the bottom disk side, which has folded flange regions at its edge regions, to which the damper elements 41 can be well fastened.

The fastening of the housing 1 to the bottom wall 36*a* of the air duct 35 results in an asymmetry as described with reference to FIG. 12. A design of the housing 1 adapted to the installation conditions can be advantageous, for example, in the form of adapted lengths L1 (16) of the side parts 7. Since the housing 1 is manufactured without contouring tools, only by trimming or punching and folding, geometry variants in the sense of, for example, modified lengths L1 can be implemented without major investment in tools, since in the best case only the trimming of the metal sheets has to be changed and the folding process has to be slightly adapted accordingly. There are no significant changes in the assembly of the housing 1 either.

Due to the asymmetrical arrangement of the housing 1 in the air duct 35, a distinction can be made at least fluidically between the various side parts 7 (7*a*-7*d*). There is the side part 7*a* associated with the bottom wall 36*a*, the side part 7*b*, which is offset approximately 90° seen in the circumferential direction in the rotational direction of the fan (counterclockwise in this view) in relation to the side part 7*a*, furthermore the side part 7*c*, which is opposite to the side part 7*a* offset approximately 180°, and the side part 7*d*, which is offset from the side part 7*a* in the circumferential direction approximately 270° in the rotational direction of the fan impeller 3. Correspondingly, lengths L1*a*-L1*d* are associated with the side parts 7*a*-7*d*. A simple construction of a housing 1 is obtained in that all lengths L1*a* to L1*d* are approximately equal (and can then be referred to as length L1 (16)) and the housing is constructed approximately rotationally symmetrically because then the integral sheet metal parts 22 can be configured to be identical to one another. In this case, it is advantageous to choose the lengths L1 (16) shorter when installing on the bottom wall of the air duct 35 in comparison to the symmetrical installation on the wall of the air duct on the nozzle plate side, for example according to FIGS. 4 and 5. This creates a larger flow area on the sides of the side walls 7*b*, 7*c* and 7*d*, because the through-flow of the side on the side wall 7*a* is completely or largely suppressed by the bottom wall 36*a* of the housing 35. In this respect, the selection of a lesser L1 (16) at least partially compensates for the negative effect of the flow blockage by the bottom wall 36*a*. The mean lengths L1 (16) of the housing 1 can then advantageously be only approximately 15%-40% of the width w (37, see FIG. 4) of the housing 1 and, in such a variant, for installation on a bottom wall 36*a* of an air duct 35 can be 10%-25% shorter than in a comparable variant that is more intended for symmetrical installation in an air duct.

Housings 1 having different lengths L1*a*-L1*d* can be produced with further fluidic advantages, but associated with higher manufacturing costs. In the installation condition shown, the length L1*a* has little influence, since the flow through the corresponding side of the housing 1 is largely blocked by the bottom wall 36*a* of the air duct 35 anyway. L1*b*>L1*c* and/or L1*b*>L1*d* and/or L1*c*>L1*d* is advantageous.

In the embodiment according to FIG. 13, it is advantageous for the efficiency if the height of the damper elements 41, which defines the distance of the bottom wall 36*a* of the air duct 35 to the housing 1, is as large as possible, so that those through-flow areas 27 which are close to the bottom wall 36*a* can also still have effective flow through them. A height of the damper elements 41 or a distance of the housing 1 from the bottom wall 36*a* of at least 10% of the mean diameter of the trailing edges of the blades 18 of the fan impeller 3 with respect to the fan axis is advantageous.

In FIG. 14, seen in a perspective view from the outflow side, a fan having a further embodiment of a housing 1 is shown installed on the bottom 36*a* of an air duct 35, wherein the plate on the bottom disk side of the housing 1 is not shown. The peculiarity of this embodiment in comparison to the embodiment according to FIG. 13 is that that side of the housing 1 which is associated with the bottom wall 36*a* of the air duct is completely closed with sheet metal, that is to say it has no through-flow area. This can have advantages, for example, from the point of view of strength. In addition, the statements made in relation to FIG. 13 also apply.

At this point it should be mentioned again that the formation of the flow-relevant contours of the side parts 7 is crucial. Thus, in contrast to the embodiments according to FIGS. 7 to 14, it is also conceivable to form corresponding housings having other divisions in integral sheet metal parts; for example, it is thus even conceivable to manufacture the housing 1 integrally having plate 6 on the bottom disk side and all side parts 7 and the stabilization region 26 from a single sheet metal plate by cutting or punching and folding.

In FIG. 15, seen in a perspective view from the outflow side, a fan having a further embodiment of a housing 1 is installed on the bottom 36*a* of an air duct 35, wherein the plate 6 on the bottom disk side of the housing is not shown. The side parts 7*a* and 7*d* are configured in such a way that essentially no through-flow region is formed between them. The housing 1 in this exemplary embodiment thus only has 3 regions through which flow occurs: between the side parts 7*a* and 7*b*, between the side parts 7*b* and 7*c*, and between the side parts 7*c* and 7*d*. This design form can be advantageous in this type of installation. In addition, the statements which were also made in relation to the embodiment according to FIG. 13 apply.

In FIG. 16, seen in a perspective view from the outflow side, a fan having a further embodiment of a housing 1 is shown, which is compact in the radial direction. The fan essentially consists of an impeller 3, a drive motor 4, a nozzle plate 5 having an inlet nozzle 2 (not visible in this illustration), and the housing 1. The housing 1 is essentially constructed from the plate 6 on the bottom disk side and four integral sheet metal parts 22. The four essentially identical integral sheet metal parts 22 are connected to one another in the circumferential direction at fastening provisions 25. In the exemplary embodiment, the fastening provisions 25 of adjacent integral sheet metal parts 22 lie exactly in the corner regions 29 of the stabilization regions 26. The stabilization regions 26 and the through-flow regions 27 are defined by the integral sheet metal parts 22, as are the aerodynamically active side parts 7 in the region of the through-flow regions 27. Each integral sheet metal part 22 here forms one planar side part 7 in its entirety. The side parts 7 each have an inflow-side edge 14 and an outflow-side edge 15. The inflow-side edge 14, seen in the rotational direction of the impeller 3, lies trailing on a side part 7; the outflow-side edge 15, seen in the rotational direction of the impeller 3, lies leading on a side part 7. The rotational direction of the impeller 3 is approximately counterclockwise in the illustration shown. The side parts 7 taper from the stabilization region 26 to the plate 6 on the bottom disk side. The inflow-side edge 14 and the outflow-side edge 15 run obliquely and not in parallel to the impeller axis. The side parts 7 are not arranged centrally between the two corresponding corner regions 29 of the stabilization region 26, but they are each slightly shifted in the rotational direction of the impeller 3 with respect to the respective center between the two corresponding corner regions 29, in the exemplary embodiment by approximately 10% of the impeller diameter.

The motor 4 is fastened to the plate 6 on the bottom disk side in a central region 31. The housing 1 is produced essentially from planar sheet metal parts, as in the embodiments according to FIGS. 1-5 and 7-15. For example, the side parts 7 and the plate 6 on the bottom disk side are essentially planar, just as the stabilization region 26 is also produced exclusively from essentially planar sheet metal components.

In FIG. 17, seen in a perspective view from the outflow side, the fan having the housing 1 according to FIG. 16 is shown, wherein the plate on the bottom disk side of the housing is not shown for reasons of illustration. In this illustration, the impeller 3, consisting essentially of a bottom disk 28, a cover disk 19, and blades 18 extending between them, can be seen better than in the illustration according to FIG. 16. The housing 1 is much more compact in the embodiment shown with respect to the impeller 3 than, for example, in the embodiments according to FIGS. 1-5 and 7-15. The distance between the impeller 3 or its cover disk 19 or its blades 18 and the side parts 7 of the housing 1 is significantly less here, for example, the distance is less than 15% of the fan diameter.

In FIG. 18, seen in an axial top view from the outflow side, the fan having the housing 1 according to FIG. 16 and FIG. 17 is shown, wherein the plate on the bottom disk side of the housing 1 is not shown for reasons of illustration. The radial compactness of the housing 1 can be seen and described based on this illustration. The housing 1 in the exemplary embodiment has an approximately square basic shape, i.e. in the axial top view shown, the housing 1 has an approximately square shape having a square side length W. Here, W denotes the side length of the fluidically relevant inner contour facing toward the impeller. In other embodiments having non-square housings, W advantageously corresponds to the side length of the smallest square circumscribed by the housing inner contour. The illustrated housing 1 is now advantageously compact, since the ratio of W to the impeller diameter D (largest diameter of a trailing edge of a blade 18 of the impeller 3) is relatively low, for example, less than 1.3. Compact housings have the significant advantage that the space required for installing the fan is low; for example, compact housings can thus be installed in air ducts with relatively small cross sections without the installation losses, i.e. the installation-related efficiency reduction, becoming too great. For example, fans having compact housings can be installed in air ducts which, viewed in cross section, have a least side length S (for S, reference is also made to FIG. 4 and the description) of less than 1.8 times the impeller diameter D.

In FIG. 19, seen in an actual top view from the outflow side, the fan having the housing 1 according to FIGS. 16 to 18 is shown, wherein the plate 4 on the bottom disk side of the housing 1 is also shown. The plate 4 on the bottom disk side has an advantageous shape. It is thus provided with corner recesses 45 in the corner regions of the housing 1 or the plate 6 on the bottom disk side. The corner recesses 45 provide efficiency and acoustic advantages, for example, if the fan having housing 1 is installed in an air duct that axially continues the flow, as shown for example with reference to FIGS. 4 and 5. For example, due to the corner recesses 45, a rotation of the housing 1 at an angle $\alpha$ with respect to the air duct 36 (compare to FIG. 4) is no longer necessary in order to achieve the best efficiency. The rotational direction of the impeller (not visible) is counterclockwise (compare to FIG. 18). In the exemplary embodiment, the corner recesses 45 are embodied as chamfers having the dimensions a (46)×b (47). Here, a (46) lies leading with respect to b (47) as seen in the rotational direction of the impeller. The length a (46) is advantageously greater than the length b (47), in the exemplary embodiment approximately twice as large, advantageously 1.5 to 3 times as large. The corner recesses 45 can also be embodied, for example, as roundings or the like, wherein equivalent characteristic variables a and b can then also be defined for the extent of the corner recesses, and a always corresponds to the leading extent in the rotational direction (with respect to the respective associated corner). The corner recesses 45 reduce the fluidically active area of the plate 6 on the floor disk side, which is approximately W×W without corner recesses. In the exemplary embodiment, each of the four corner recesses 45 reduces the effective area of the plate 6 on the bottom disk side by an area of approximately 3.5% based on W×W, values of 2%-5% are advantageous here. In the exemplary embodiment, the length a (46) is approximately 35% of the length W (37), 20% to 40% are advantageous.

In FIG. 20, the fan having housing 1 according to the embodiment according to FIGS. 16 to 19 is shown in a side view. The axial position of the impeller 3 with respect to the housing 1, its stabilization region 26, and its flow region 27 can be clearly seen. In the exemplary embodiment, the stabilization region 26 extends axially from the nozzle plate 5 slightly over the cover disk 19, i.e. the outflow area of the impeller 3 defined between the bottom disk 28 and the cover disk 19 is at most minimally covered in the radial direction by the stabilization region. In this embodiment of the housing 1, which is compact and the side walls 7 and the stabilization region 26 of which are only at a small distance in the radial direction from the impeller 3, this is advantageous in order to achieve high efficiencies. The motor 4 to which the impeller 3 is fastened is fastened to the side parts 7 and thus ultimately to the nozzle plate 5 via the plate 6 on the bottom disk side. The housing 1 is thus configured to be load-bearing. The side parts 7 have inflow edges 14 and outflow edges 15, wherein the inflow edges 14 for each side part 7 lie in front of the outflow edges 15 as seen in the rotational direction of the impeller.

Figure 21:
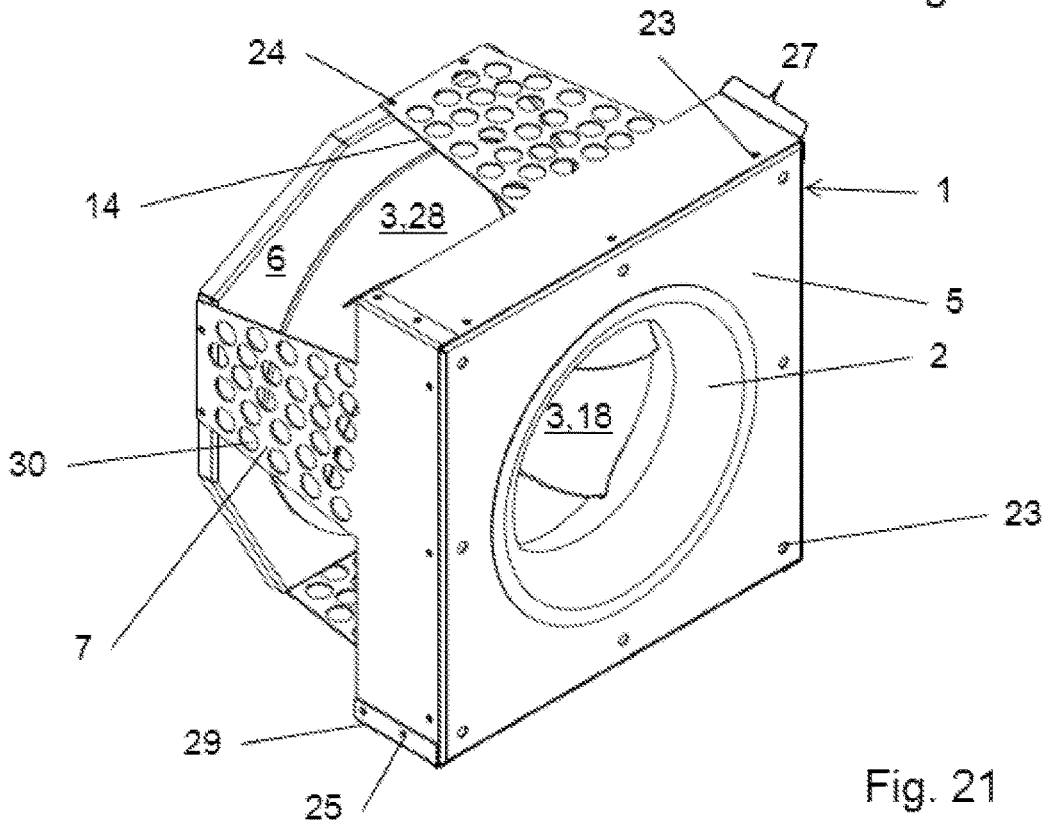

FIG. 21 shows, seen in a perspective view from the inflow side, a fan having a further embodiment of a housing 1 which is compact in the radial direction and the side parts of which are perforated. The side parts 7 are provided with perforations 30, i.e. a large number of openings. In the exemplary embodiment, these perforations 30 are approximately circular, but can have almost any conceivable shape, for example quadrilateral, hexagonal, or they can also have greatly varying shapes in relation to one another in an unstructured manner. The size of the perforations can also be selected within a relatively large range. Here approximately 28 perforations are provided per side part, approximately 10-50 are advantageous. The perforations 30 reduce the tonal sound that occurs on the pressure side as a result of the side parts 7. The total area proportion that is left out by the perforations from the side parts, considered without perforations, is in the range of approximately 50%, 40%-90% are advantageous. The more area is left out, the better the pressure-side noise is reduced. However, since this is a load-bearing embodiment of a housing, sufficient material must also remain at the side parts 7 in order to achieve the necessary strength of the housing 1. The perforations can create a relatively rigid structure similar to a truss structure in the remaining material. The metal sheets in the stabilization region 27 can also advantageously be perforated in order to further improve the pressure-side sound radiation. It can also advantageously be perforated only locally in those regions where significant sound radiation would be expected, for example, in the vicinity of the inflow edge 14 of the side parts 7.

With the exception of the perforations 30, this embodiment corresponds to that according to FIGS. 16-20, which is why reference can also be made to the description of these figures. The fastening provisions 23, using which the housing 1 is fastened to the nozzle plate 5, and the inlet nozzle 2 can still be seen well here. Fastening devices 24 are also used to fasten the plate 6 on the bottom disk side to the side parts 7 and fastening devices 25 are used to connect adjacent integral sheet metal parts 22 in corner regions 29 of the stabilization region 27 to one another in the circumferential direction.

In FIG. 22, curves of the static pressure increases and the suction-side sound powers of a fan without a housing and of a fan having a housing according to this disclosure at the same, constant speed are shown. This illustration clarifies, in addition to FIG. 6 and the associated description, the mode of action of a housing, in that characteristic curves of a fan with housing are compared therein to characteristic curves of an otherwise identical fan, for example, having the same impeller, in which, however, the housing was replaced by a largely fluidically neutral motor suspension. The curve 48 shows the course of the static pressure increase for the housing-less fan as a function of the delivery volume flow. The fan having housing has the characteristic curve 49 for the static pressure increase as a function of the delivery volume flow. By using the housing, significantly greater static pressure increases can be achieved than with the housing-less fan, in a range of 5% to 10% more static pressure increase at the same speed, for example, with rather lower delivery volume flows.

Furthermore, the curve 50 shows the suction-side sound power of the housing-less fan as a function of the air volume flow and, in comparison to this, the curve 51 shows the suction-side sound power of the fan having housing. In the range of rather low flow rates and large pressure increases, this sound power is significantly reduced by using the housing, in large ranges by more than 5 dB (each two adjacent horizontal auxiliary lines are spaced 5 dB apart on the suction side).

Furthermore, a constant air volume flow 57 is shown as a dotted line; for this air volume flow, sound pressure spectra are also shown for comparison in FIG. 23.

FIG. 23 shows spectra of the suction-side sound pressure of a fan without a housing (curve 55) and a fan having a housing according to this disclosure (curve 56) at constant speed and the same delivery volume flow at the delivery volume flow 57 shown in FIG. 22. The frequency resolution in the diagram shown is 3,125 Hz, but with other frequency resolutions the same effects can be seen qualitatively. The frequency 54 shown is the blade repetition frequency of the impeller of the fan, it corresponds to the product of the rotational frequency of the impeller in revolutions per second with the number of blades per impeller. The sound pressure in the range of this frequency is significantly increased with the housing-less fan (curve 55) as well as with the fan having a housing (curve 56) in comparison to the general trend of the curves. The corresponding sound is called the blade passing sound. However, the excessive increase in the sound pressure curves in the form of excessive increase ranges 55 (housing-less fan) and 56 (fan having housing) is decisive for the mode of operation of the housing. The sound corresponding to this is called subharmonic sound; it occurs regularly with backward curved fans at a frequency of approximately 70%-90% of the blade repetition frequency. It can be seen that the subharmonic sound, which is generally dependent on the delivery volume flow, is massively reduced with the delivery volume flow shown for the fan having housing, in the example shown by around 10 dB, generally by 1-15 dB depending on the operating point and frequency resolution. The frequency of the subharmonic sound is also shifted slightly downwards, by approximately 5%-20% of the blade repetition frequency. This reduction and frequency shift of the subharmonic sound is achieved by a flow stabilization by a housing according to this disclosure. This is a very characteristic feature of a housing according to this disclosure. Depending on the embodiment, the remaining sound, for example the blade passing sound at the blade repetition frequency 54 or the broadband sound, can be higher or lower in a fan having a housing than in the fan without a housing. The only decisive factor for the description of the mode of action is the reduction of the subharmonic sound in the case of the fan having housing.

With regard to further advantageous embodiments of the teaching according to this disclosure, reference is made to the general part of the description and to the appended claims in order to avoid repetitions.

Finally, it is to be expressly noted that the above-described exemplary embodiments of the teaching according to this disclosure are used solely to explain the claimed teaching, but does not restrict it to the exemplary embodiments.

LIST OF REFERENCE SIGNS

1 housing
2 inlet nozzle

3 fan impeller
4 motor
5 nozzle plate
6 plate on the bottom disk side of the housing
7 side part of the housing
7*a* bottom side part of the housing
7*b* side part of the housing laterally in the rotational direction with respect to bottom
7*c* top side part of the housing
7*d* side part of the housing laterally against the rotational direction with respect to bottom
8 planar region of a side part
9 rounded transition region of the plate on the bottom disk side
10 straight transition region of the plate on the bottom disk side
11 planar subregion of a side part
12 transition between two planar regions
13 radially outermost planar region of a side part
14 inflow-side edge of a side part
15 outflow-side edge of a side part
16 (mean) length L1 of the radially outermost planar region
17 (mean) distance L2 between the radially outermost planar regions of two adjacent side parts
18 blades of the fan impeller
19 cover disk of the fan impeller
20 exemplary characteristic curve without housing
21 exemplary characteristic curve with housing
22 integral sheet metal part
23 fastening provisions for housing-nozzle plate
24 fastening provisions for side parts-plate on the bottom disk side
25 fastening provisions between adjacent integral sheet metal parts
26 stabilization region near the nozzle plate
27 through-flow region near the plate on the bottom disk side
28 bottom disk of the impeller
29 corner region of the stabilization region 26
30 perforation of a side part
31 central region of the plate on the bottom disk side
32 connecting region to the nozzle plate
33 trailing edge of a blade of the fan impeller
34 radially innermost planar region of a side part 7
35 air duct
36 side wall of the air duct 35
36*a* bottom wall of the air duct 35
37 width w of the housing 1
38 width s of the air duct 35
39 angle α between housing 1 and air duct 35
40 smallest square circumscribed around the housing 1
41 floor fastening or damper element
42 edge of a side part towards the stabilization region
43 edge of a side part towards the stabilization region
44 impeller diameter D
45 corner recess on the plate 6 on the bottom disk side
46 length of the corner recess a for an inflow-side edge 14
47 length of the corner recess b for an outflow-side edge 15
48 characteristic curve of static pressure increase without housing
49 characteristic curve of static pressure increase with housing
50 characteristic curve of suction-side sound power without housing
51 characteristic curve of suction-side sound power with housing
52 suction-side sound pressure spectrum without housing
53 suction-side sound pressure spectrum with housing
54 blade passing sound frequency
55 subharmonic sound pressure increase range without housing
56 subharmonic sound pressure increase range with housing
57 exemplary operating point

The invention claimed is:

1. A housing for a fan, comprising:
wall regions forming the housing,
wherein the wall regions are substantially planar or flat,
wherein the wall regions are manufactured from substantially regionally planer shaped parts,
wherein the wall regions intersect with each other in a straight line or to form an angle with respect to one another,
wherein a shaped part on a bottom disk side is arranged in parallel to and at a distance from a nozzle plate of the fan to which the housing is mounted or a shaped part on a nozzle plate side, wherein the distance is defined by planar shaped parts arranged to form side parts; and
wherein the planar shaped parts which form the side parts also form a stabilization region which extends part of the way between a nozzle plate of a fan to which the housing is mounted and the bottom disk side, and wherein the planar shaped parts along the stabilization region extend substantially around the entire circumference in a substantially closed manner.

2. The housing according to claim 1, wherein the wall regions form an approximately 90° rotational symmetry.

3. The housing according to claim 1, wherein the shaped part on the bottom disk side is angular or square or has chamfers or radii, the chamfers or radii having a convexly curved outer contour, the shaped parts-part not having corners.

4. The housing according to claim 1, wherein the side parts are formed from 1, 2 or 3 planar subregions which intersect with each other in a straight line or at an angle to one another to form the respective side parts.

5. The housing according to claim 1, wherein the side parts, viewed in an axial direction, extend over a through-flow region and, viewed in the circumferential direction, only partially extend over the respective side of the housing and, with their thus reduced area, block a part of the actual through-flow area and define air outlets with openings thus formed between adjacent side parts in the circumferential direction.

6. The housing according to claim 5, wherein the side parts each have an inflow-side and an outflow-side edge, wherein the air outlets each extend between the outflow-side edge of one part of the side parts and the inflow-side edge of an adjacent one of the side parts in the rotational direction of an associated fan impeller of a fan to which the housing is mounted.

7. The housing according to claim 6, wherein the inflow-side and/or outflow-side edges are configured to extend obliquely to an axis of the fan to which the housing is mounted, and have an angle of between 5° and 45° in relation thereto.

8. The housing according to claim 6, wherein the inflow-side and/or outflow-side edges are provided with waves, serrations, or other flow-influencing measures in a sense of trimming the substantially planar wall regions.

9. The housing according to claim 1, wherein the planar or flat wall regions are at least largely integrally manufactured by trimming and folding or bending a sheet metal plate.

10. The housing according to claim 1, wherein a side length of a substantially square footprint of an enveloping cuboid of the housing is approximately 1.4 to 1.8 times a mean diameter of a blade trailing edge of an impeller of a fan to which the housing is mounted.

11. The housing according to claim 1, wherein the housing is configured to be installed within an air duct having multiple air outlets.

12. The housing according to claim 11, wherein the housing is configured to be installed at a bottom of the air duct.

13. The housing according to claim 12, wherein the housing is configured to be installed via damper elements.

14. The housing according to claim 1, further comprising a fan installed in the housing.

15. The housing according to claim 1, wherein the housing is configured for use with a radial or diagonal fan.

16. A housing for a fan, comprising:

wall regions forming the housing, wherein the wall regions are substantially planar or flat, wherein the wall regions are manufactured from substantially regionally planer shaped parts, wherein the wall regions intersect with each other in a straight line or to form an angle with respect to one another, wherein a shaped part on a bottom disk side is arranged in parallel to and at a distance from a nozzle plate of the fan to which the housing is mounted or a shaped part on a nozzle plate side, wherein the distance is defined by planar shaped parts arranged to form side parts; and wherein the side parts, viewed in an axial direction, extend over a through-flow region and, viewed in the circumferential direction, only partially extend over the respective side of the housing and, with their thus reduced area, block a part of the actual through-flow area and define air outlets with openings thus formed between adjacent side parts in the circumferential direction; and wherein the side parts each have an inflow-side and an outflow-side edge, wherein the air outlets each extend between the outflow-side edge of one part of the side parts and the inflow-side edge of an adjacent one of the side parts in the rotational direction of an associated fan impeller of a fan to which the housing is mounted; and wherein the inflow-side and/or outflow-side edges are configured to extend obliquely to an axis of the fan to which the housing is mounted, and have an angle of between 5° and 45° in relation thereto.

17. A housing for a fan, comprising:

wall regions forming the housing, wherein the wall regions are substantially planar or flat, wherein the wall regions are manufactured from substantially regionally planer shaped parts, wherein the wall regions intersect with each other in a straight line or to form an angle with respect to one another, wherein a shaped part on a bottom disk side is arranged in parallel to and at a distance from a nozzle plate of the fan to which the housing is mounted or a shaped part on a nozzle plate side, wherein the distance is defined by planar shaped parts arranged to form side parts; and wherein the side parts, viewed in an axial direction, extend over a through-flow region and, viewed in the circumferential direction, only partially extend over the respective side of the housing and, with their thus reduced area, block a part of the actual through-flow area and define air outlets with openings thus formed between adjacent side parts in the circumferential direction; and wherein the side parts each have an inflow-side and an outflow-side edge, wherein the air outlets each extend between the outflow-side edge of one part of the side parts and the inflow-side edge of an adjacent one of the side parts in the rotational direction of an associated fan impeller of a fan to which the housing is mounted; and wherein the inflow-side and/or outflow-side edges are provided with waves, serrations, or other flow-influencing measures in a sense of trimming the substantially planar wall regions.

* * * * *